US008781819B2

(12) United States Patent
Kawahara et al.

(10) Patent No.: US 8,781,819 B2
(45) Date of Patent: Jul. 15, 2014

(54) PERIODIC SIGNAL PROCESSING METHOD, PERIODIC SIGNAL CONVERSION METHOD, PERIODIC SIGNAL PROCESSING DEVICE, AND PERIODIC SIGNAL ANALYSIS METHOD

(75) Inventors: Hideki Kawahara, Wakayama (JP); Masanori Morise, Takaraduka (JP); Toru Takahashi, Kyoto (JP); Toshio Irino, Osaka (JP)

(73) Assignee: Wakayama University, Wakayama (JP)

( * ) Notice: Subject to any disclaimer, the term of this patent is extended or adjusted under 35 U.S.C. 154(b) by 967 days.

(21) Appl. No.: 12/669,533

(22) PCT Filed: Jul. 18, 2008

(86) PCT No.: PCT/JP2008/063072

§ 371 (c)(1),
(2), (4) Date: Jun. 14, 2010

(87) PCT Pub. No.: WO2009/011438

PCT Pub. Date: Jan. 22, 2009

(65) Prior Publication Data

US 2011/0015931 A1 Jan. 20, 2011

(30) Foreign Application Priority Data

Jul. 18, 2007 (JP) ..... P2007-187697
Nov. 6, 2007 (JP) ..... P2007-289006

(51) Int. Cl.
*G10L 25/00* (2013.01)

(52) U.S. Cl.
USPC ..... 704/207

(58) Field of Classification Search
USPC ..... 704/200–230
See application file for complete search history.

(56) References Cited

U.S. PATENT DOCUMENTS

| | | | | |
|---|---|---|---|---|
| 5,517,595 | A * | 5/1996 | Kleijn | 704/205 |
| 5,536,902 | A * | 7/1996 | Serra et al. | 84/623 |
| 6,014,617 | A * | 1/2000 | Kawahara | 704/207 |
| 6,115,684 | A * | 9/2000 | Kawahara et al. | 704/203 |

FOREIGN PATENT DOCUMENTS

| | | |
|---|---|---|
| JP | 02-047700 | 2/1990 |
| JP | 10-097287 | 4/1998 |
| JP | 11-014672 | 1/1999 |
| JP | 2003-263170 | 9/2003 |

OTHER PUBLICATIONS

Brown et al.; Digital Implementations of Spectral Correlation Analyzers; Signal Processing, IEEE Transactions on vol. 41, Issue:2, pp. 703-720; Pub. Year 1993.*

(Continued)

*Primary Examiner* — Abul Azad
(74) *Attorney, Agent, or Firm* — Harness, Dickey & Pierce, P.L.C.

(57) ABSTRACT

The invention relates to a periodic signal processing method, a periodic signal conversion method, and a periodic signal processing device capable of reducing the influence of periodicity without using a spectral model. Time windows are arranged such that a center of each of the time windows is at a division position which divides a fundamental frequency in a temporal direction into fractions 1/n (where n is an integer equal to or larger than 2) so as to extract a plurality of portions of different ranges from a signal having periodicity. A power spectrum for the plurality of portions extracted by the respective time windows is calculated, and the calculated power spectrum is added with a same ratio.

12 Claims, 21 Drawing Sheets

(56) References Cited

OTHER PUBLICATIONS

Extended Search Report for corresponding European patent application No. 08778299.1 dated Jul. 30, 2012.
Notification of Transmittal of Translation of the International Preliminary Report on Patentability (Chapter I or Chapter II of the Patent Cooperation Treaty) for International Application No. PCT/JP2008/063072 mailed Feb. 18, 2010.
Notification Concerning Transmittal of International Preliminary Report on Patentability (Chapter I of the Patent Cooperation Treaty) for International Application No. PCT/JP2008/063072 mailed Jan. 28, 2010.
International Search Report mailed Oct. 7, 2008 for corresponding Japanese Patent Application No. PCT/JP2008/063072.
Hideki Kawahara et al., "Straight ni Okeru Jikan Shuhasu Bunseki no Atarashii Teishikika to Jisso ni Tsuite", The Acoustical Society of Japan (ASJ) Koen Ronbunshu CD-ROM, Sep. 12, 2007, pp. 347-348.
Hideki Kawahara et al., "Tandem-Straight: A Temporally Stable Power Spectral Representation for Periodic Signals and Applications to Interference-Free Spectrum, F0, and Aperiodicity Estimation" Proc. ICASSP 2008, Las Vegas, pp. 3933-3936 (2008).
Satoshi Imai, et al., "Speech Analysis Synthesis System Using the Log Magnitude Approximation Filter", Journal of the Institute of Electronic and Communication Engineers, 78/6, vol. J61-A, No. 6, pp. 527-534 with partial English translation.
Kazuo Nakata, "A Formant Extraction not influenced by Pitch Frequency Variations", Journal of Japanese Acoustic Sound Association, vol. 50, No. 2 (1994), pp. 110-116 with partial English translation.
Amro Ei-Jaroudi, et al., "Discrete All-Pole Modeling", IEEE Transactions on Signal Processing, vol. 39, No. 2, Feb. 1991, pp. 411-423.
Douglas B. Paul, "The Spectral Envelope Estimation Vocoder", IEEE Transactions on Acoustics, Speech, and Signal Processing, vol. ASSP-29, No. 4, Aug. 1981, pp. 786-794.

* cited by examiner

PERIODIC SIGNAL PROCESSING METHOD, PERIODIC SIGNAL CONVERSION METHOD, PERIODIC SIGNAL PROCESSING DEVICE, AND PERIODIC SIGNAL ANALYSIS METHOD

TECHNICAL FIELD

The present invention relates to a periodic signal processing method, a periodic signal conversion method, a periodic signal processing device, and a periodic signal analysis method. In particular, the present invention relates to a periodic signal processing method and a periodic signal processing device for processing a periodic signal such as sound, a periodic signal conversion method for converting a periodic signal such as sound, and a periodic signal analysis method for analyzing a fundamental period or an aperiodic component of a periodic signal such as sound.

BACKGROUND ART

When, in an analysis/synthesis of speech sound, an intonation of speech sound is controlled or when speech sound is synthesized for editorial purposes to provide the intonation of natural speech sound, the fundamental frequency of speech sound should be converted while maintaining the tone of the original speech sound. When sound in the natural world is sampled for use as a sound source of an electronic musical instrument, the fundamental frequency should be converted while maintaining constant tone. In such conversion of the fundamental frequency, the fundamental frequency should be set more finely than the resolution determined by the sampling period. When speech sound is changed so as to conceal the individual features of an information provider for the purpose of protecting his/her privacy, the tone should be changed with the pitch unchanged, or the tone and pitch should be changed.

There is an increasing demand for reuse of existing speech sound resources such as synthesizing voices of different actors into a new voice without employing a voice actor. As society ages, there will be more people with a difficulty of hearing speech sound or music due to various kinds of hearing impairment or cognitive impairment. There is therefore a strong demand for a method of converting the speed, frequency band, or pitch of a voice to be adapted to the deteriorated hearing or cognitive ability with no loss of original information.

To achieve such an object, a model representing a spectral envelope is assumed, and the parameters of the model are optimized by approximation taking into consideration the spectrum peak under an appropriate evaluation function to seek a spectral envelope (for example, see "Speech Analysis Synthesis System Using the Log Magnitude Approximation Filter" by Satoshi IMAI and Tadashi KITAMURA, Journal of the Institute of Electronic and Communication Engineers, 78/6, Vol. J61-A, No. 6, pp 527-534).

Further, the idea of periodic signals is combined into a method of estimating parameters for an autoregressive model (for example, see "A Formant Extraction not influenced by Pitch Frequency Variations" by Kazuo Nakata, Journal of Japanese Acoustic Sound Association, Vol. 50, No. 2 (1994), pp 110-116).

Any of the related art techniques is based on the assumption of a specific model, so the related art techniques cannot provide correct estimation of a spectral envelope unless the number of parameters to describe a model should be appropriately determined. In addition, if the nature of a signal source is different from an assumed model, a component resulting from the periodicity is mixed in the estimated spectral envelope, and an even larger error may occur. Furthermore, the related art techniques require iterative operations for convergence in the process of optimization, and therefore are not suitable for applications with a strict time limitation such as real-time processing.

In addition, in terms of control of the periodicity, since the sound source and the spectral envelope are separated as a pulse train and a filter, respectively, the periodicity of a signal may not be specified with higher accuracy than the temporal resolution determined by a sampling frequency.

In another related art technique, speech sound processing referred to as PSOLA (Pitch Synchronous OverLap Add) is performed by reduction/expansion of waveforms and time-shifted overlapping in the temporal domain.

In this related art technique, if the periodicity of the sound source is changed by about 20% or more, speech sound is deprived of its natural quality, and speech sound cannot be converted in a flexible manner.

In the related art techniques, in terms of extraction of the fundamental frequency, design is carried out with no logical conclusion of the conditions for extraction of the fundamental frequency based on speech synthesis, so reasonable design is not carried out. In addition, there is no principle of the temporal resolution, and the size of a time window is determined by a trial-and-error method or the like. For this reason, when a signal synthesized using the extracted fundamental frequency is re-analyzed, a fundamental frequency different from the fundamental frequency used for synthesis may be obtained.

In the related art techniques, since the physical attributes are not systematically associated with aperiodicity, an influence by temporal changes in the fundamental frequency and temporal changes in the spectrum may be extracted as an aperiodic component, and as a result, an accurate value for synthesis may not be extracted.

DISCLOSURE OF INVENTION

Accordingly, it is an object of the invention to provide a periodic signal processing method, a periodic signal conversion method, and a periodic signal processing device capable of reducing the influence of periodicity without using a spectral model, and a periodic signal analysis method capable of obtaining a fundamental period and an aperiodic component of a signal having periodicity.

The invention provides a periodic signal processing method comprising:

arranging time windows such that a center of each of the time windows is at a division position which divides a fundamental frequency in a temporal direction into fractions 1/n (where n is an integer equal to or larger than 2) so as to extract a plurality of portions of different ranges from a signal having periodicity;

calculating a power spectrum for the plurality of portions extracted by the respective time windows; and adding the calculated power spectrum with a same ratio to obtain a first power spectrum.

In the invention, it is preferable that the method comprising convolving a rectangular smoothing function having a width corresponding to a fundamental period in a frequency direction on the obtained first power spectrum.

In the invention, it is preferable that the method comprising:

calculating a cumulative sum of the first power spectra for every predetermined range in the frequency direction, and calculating a difference in the cumulative sum of the power spectra in the predetermined range between two points at a predetermined interval in the frequency direction and performing linear interpolation to obtain a smoothed power spectrum.

In the invention, it is preferable that the smoothed power spectrum obtained by the linear interpolation is subjected to logarithmic transformation, predetermined correction, and exponential transformation.

The invention provides a periodic signal analysis method, comprising: dividing a first power spectrum obtained by a periodic signal processing method comprising arranging time windows such that a center of each of the time windows is at a division position which divides a fundamental frequency in a temporal direction into fractions 1/n (where n is an integer equal to or larger than 2) so as to extract a plurality of portions of different ranges from a signal having periodicity; calculating a power spectrum for the plurality of portions extracted by the respective time windows; and adding the calculated power spectrum with a same ratio, by a second power spectrum obtained by convolving a rectangular smoothing function having a width corresponding to a fundamental period in a frequency direction; obtaining a deviation spectrum with only a component due to periodicity obtained by subtracting 1 from a result obtained by the division of the first power spectrum; and obtaining a value of the fundamental period by calculating a weighted Fourier transform.

The invention provides a periodic signal analysis method, comprising: contracting/dilating a time axis with a ratio in inverse proportion to an instantaneous frequency of a frequency of a fundamental period; and, for a signal having periodicity converted so as to apparently become a signal having a frequency of a predetermined fundamental period, calculating a ratio of a periodic component in the signal as an absolute value of a signal, which is obtained by convolving a quadrature signal designed using a frequency of a fundamental period set in advance on a deviation spectrum with only a component due to periodicity obtained by subtracting 1 from a result obtained by dividing the first power spectrum by the second power spectrum, so as to calculate a ratio of an aperiodic component in the signal.

The invention provides a periodic signal conversion method of converting the periodic signal into a different signal by using a spectrum obtained by the periodic signal processing method mentioned above.

The invention provides a periodic signal processing device, comprising:

an extraction unit which arranges time windows such that a center of each of the time windows is at a division position which divides a fundamental frequency in a temporal direction into fractions 1/n (where n is an integer equal to or larger than 2) so as to extract a plurality of portions of different ranges from a signal having periodicity;

a calculation unit which calculates a power spectrum for the plurality of portions extracted by the respective time windows; and an addition unit which adds the calculated power spectrum with a same ratio.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
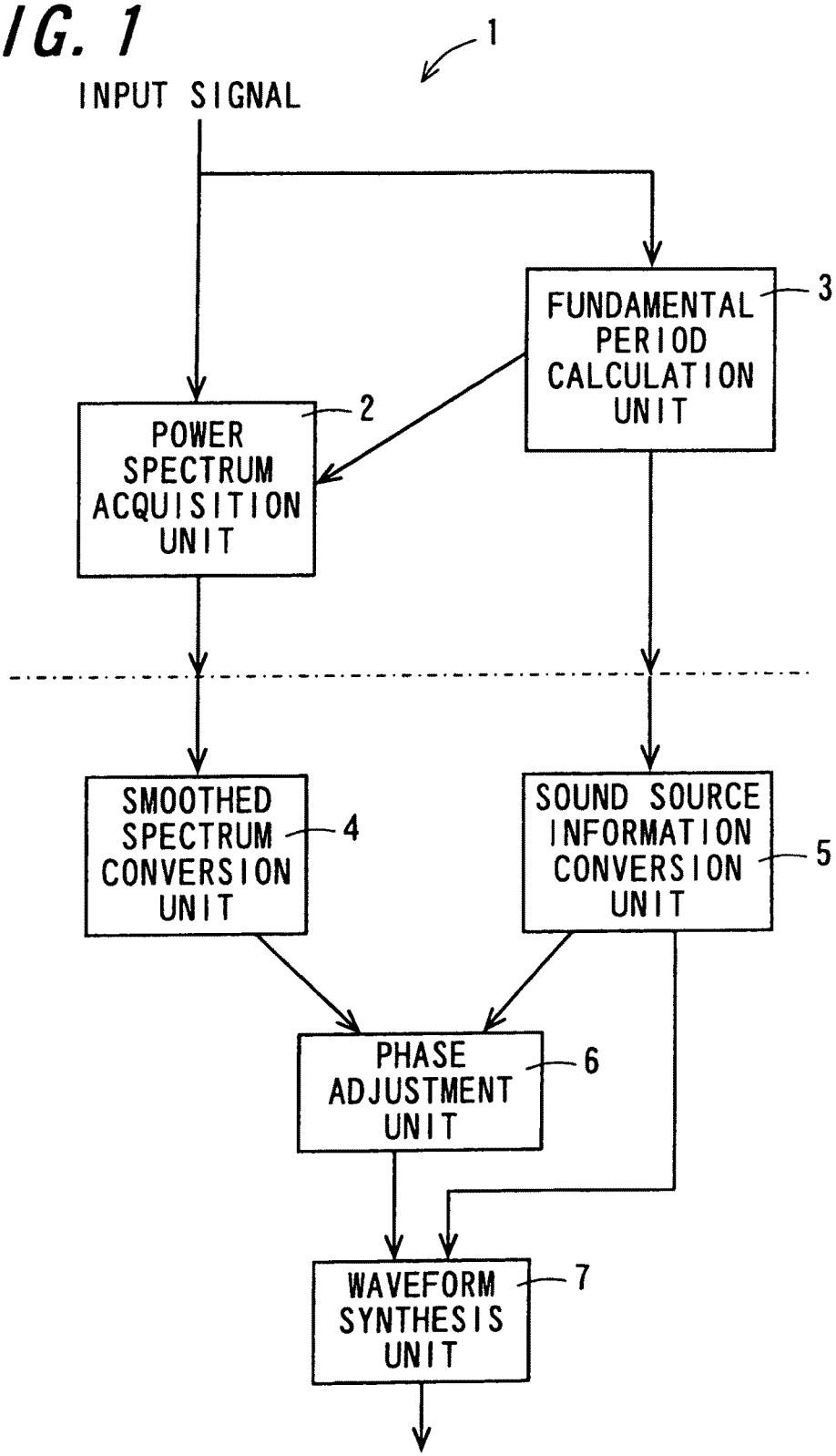
FIG. 1 is a schematic block diagram showing a periodic signal conversion device 1 for realizing a speech conversion method according to an embodiment of the invention.

Now referring to the drawings, preferred embodiments of the invention are described below.

Figure 2:
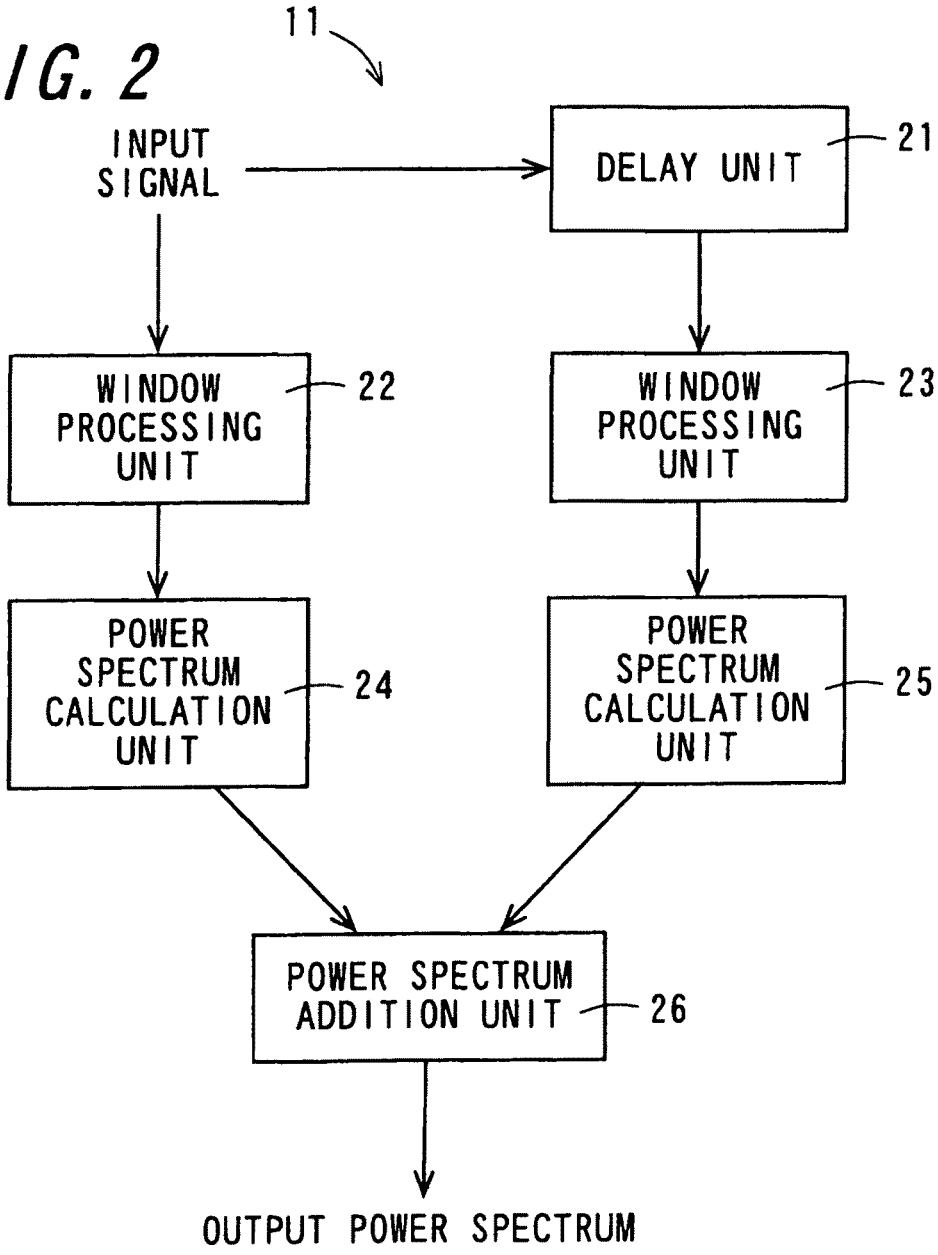
FIG. 2 is a schematic block diagram showing a power spectrum acquisition unit 2 in the periodic signal conversion device 1.
Figure 3:
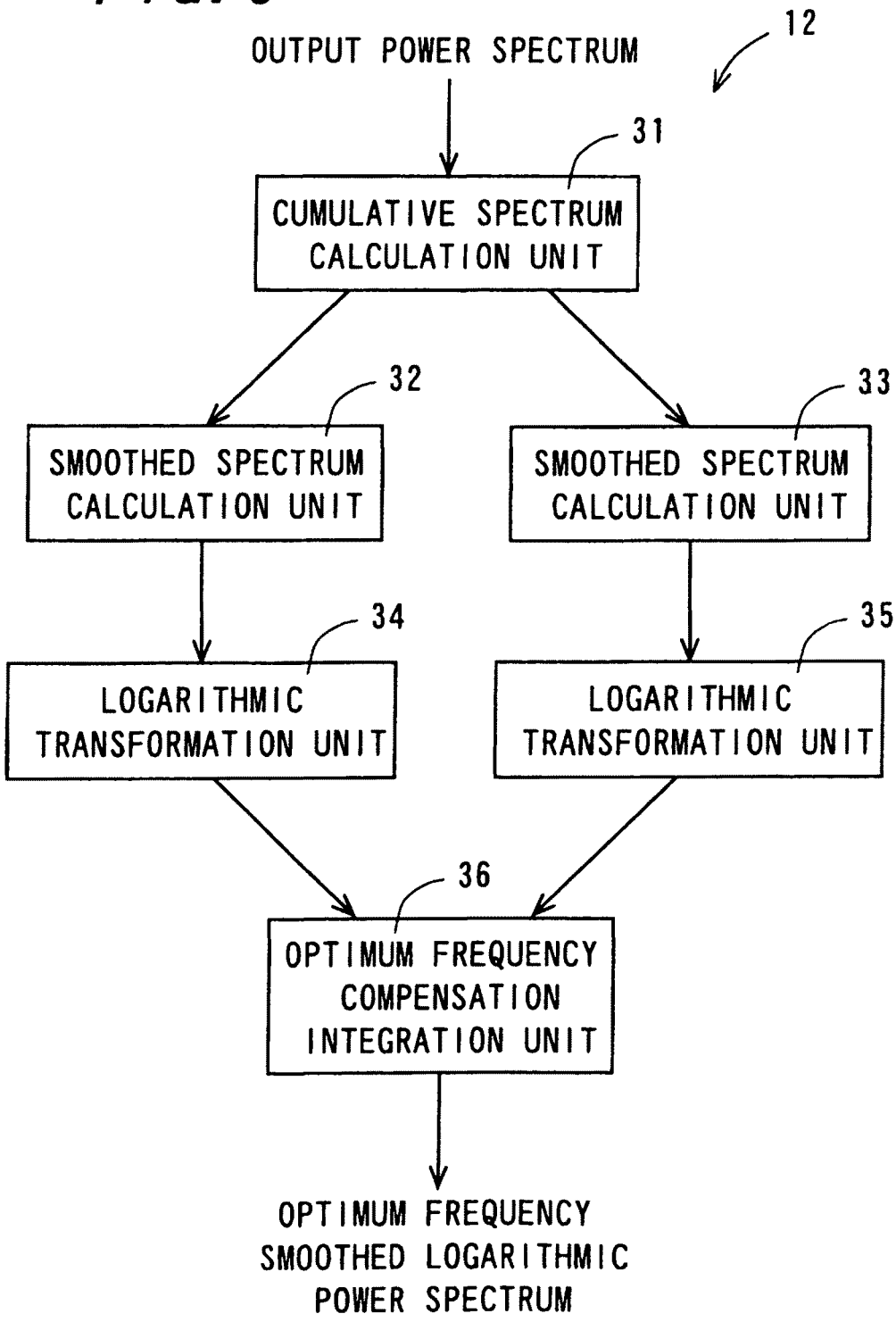
FIG. 3 is a schematic block diagram showing the power spectrum acquisition unit 2 in the periodic signal conversion device 1.
Figure 4:
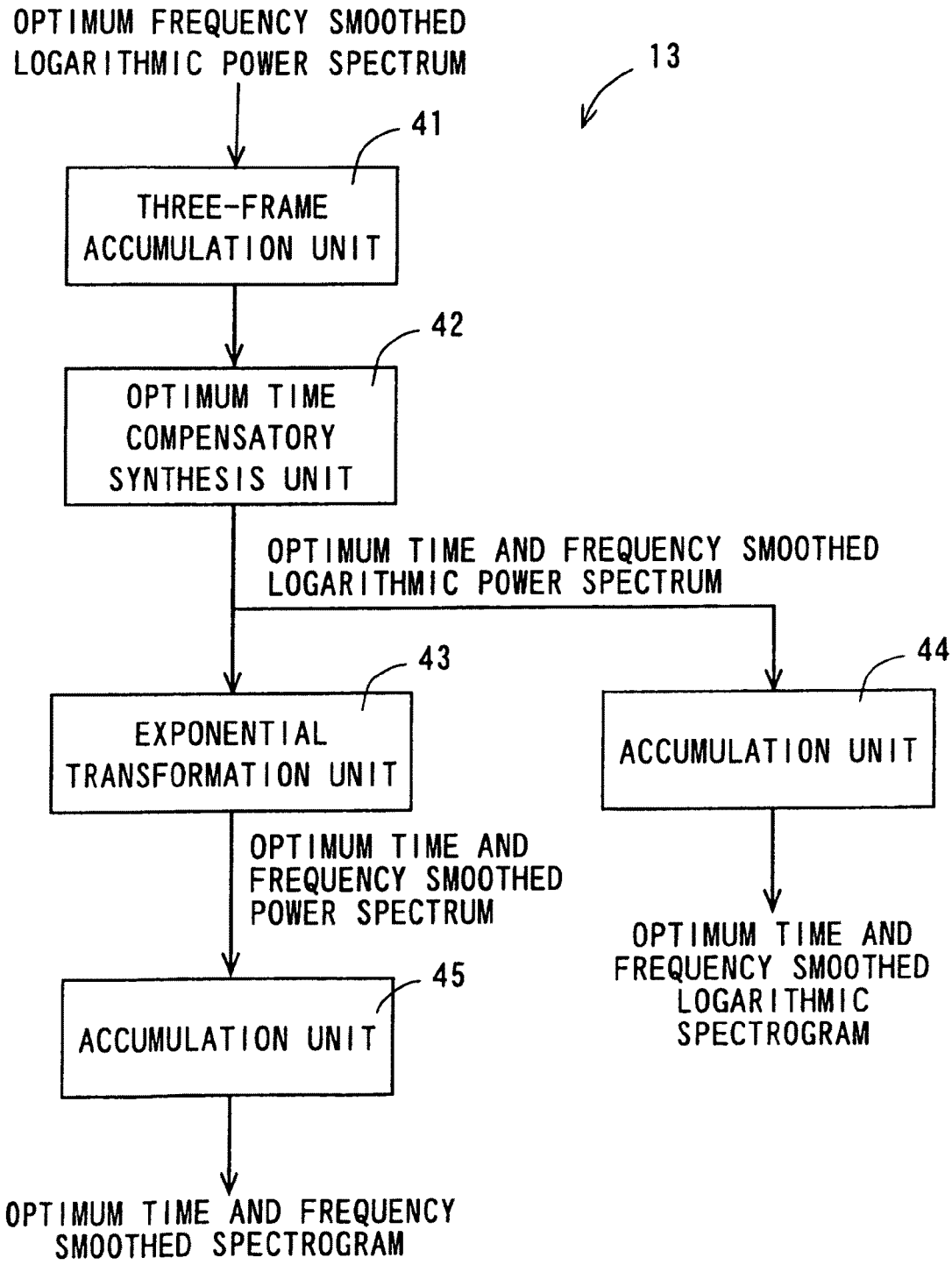
FIG. 4 is a schematic block diagram showing the power spectrum acquisition unit 2 in the periodic signal conversion device 1.

FIG. 1 is a schematic block diagram showing a periodic signal conversion device 1 for realizing a speech conversion method according to an embodiment of the invention. FIGS. 2 to 4 are schematic block diagrams showing a power spectrum acquisition unit 2 in the periodic signal conversion device 1. The speech conversion method includes a periodic signal processing method. The periodic signal conversion device 1 takes advantage of the periodicity of a speech signal and provides a spectral envelope by direct calculation without the necessity of calculations including iteration and determination of convergence. Phase manipulation is conducted upon re-synthesizing the signal from thus produced spectral envelope so as to control the period and tone with a finer resolution than the sampling period. The periodic signal conversion device 1 is realized by a microcomputer. A processing circuit such as a CPU (Central Processing Unit) executes a predetermined program, thereby realizing the periodic signal conversion device 1.

The periodic signal conversion device 1 includes a power spectrum acquisition unit 2, a fundamental period calculation unit 3, a smoothed spectrum conversion unit 4, a sound source information conversion unit 5, a phase adjustment unit 6, and a waveform synthesis unit 7. These units function when the processing circuit executes predetermined programs. An example of converting speech sound sampled at 22.05 kHz with 16 bit quantization using the periodic signal conversion device 1 will be described.

The power spectrum acquisition unit 2 extracts portions of two different ranges by a time set in advance in a temporal direction in the range of one period from a signal having a periodicity using a window function (time window), calculates a power spectrum for two portions extracted by the window function, adds the calculated power spectrum with the same ratio, and obtains a spectrogram on the basis of the cumulative sum in the frequency direction of the power spectrum. The power spectrum acquisition unit 2 is a periodic signal processing device.

Figure 5:
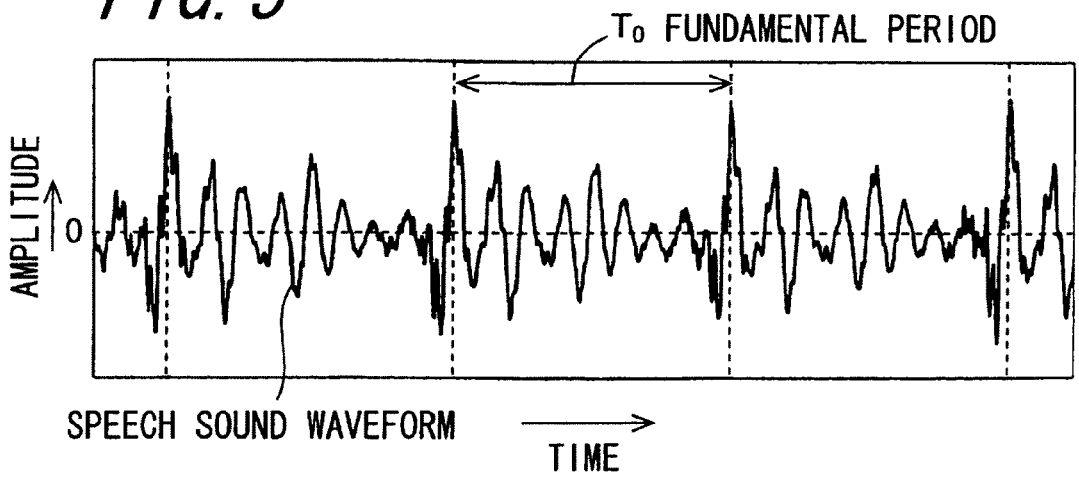
FIG. 5 is a graph showing a speech sound waveform as an input signal.
Figure 6:
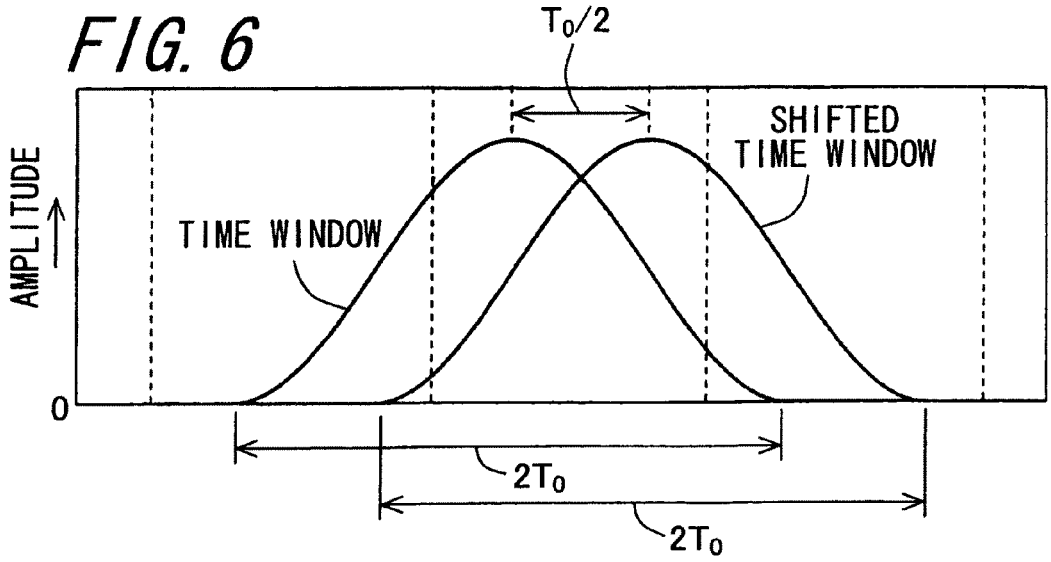
FIG. 6 is a graph showing a window function.

First, the principle will be described below. FIG. 5 is a graph showing a speech sound waveform as an input signal. FIG. 6 is a graph showing a window function. In FIGS. 5 and 6, the horizontal axis represents time and the vertical axis represents amplitude.

The periodic signal processing method of the invention theoretically ensures that the power spectrum acquisition unit 2 can principally eliminate changes in the temporal direction completely. In the periodic signal processing method, a power spectrum obtained from one kind of time window (window function) and a power spectrum obtained after the same time window has been shifted in the temporal direction by a time set in advance are added with the same ratio, thereby obtaining a desired power spectrum. The time set in advance is half of one period (that is, a fundamental period). Thereafter, a power spectrum obtained from one kind of time window (window function) and a time window shifted in the temporal direction by a time set in advance may be collectively referred to as a TANDEM window.

With regard to a window function for use in the periodic signal processing method, any window function may be used insofar as, when a periodic signal is analyzed, there is a sufficiently small influence of a harmonic component adjacent to a power spectrum of a harmonic component and a farther harmonic component.

First, a time window for extracting part of an input signal is prepared. It is assumed that the frequency characteristic of the time window is of a low-pass type and passes a direct current component. When the time window has a band-pass characteristic, synchronous detection is conducted with a signal having the same frequency as a center frequency, thereby converting the center frequency into a direct current. Therefore, such characteristic specification inhibits loss of generality of discussion. The time window is expressed by w(t). A Fourier transform of the time window w(t) is expressed by H(ω). Here, ω represents an angular frequency. H(ω) has a low-pass characteristic, so a component having an angular frequency equal to or larger than a given angular frequency $\omega_0=2\pi f_0$ is not passed. Here, $f_0$ represents a frequency corresponding to $\omega_0$. In real situations, a component equal to or larger than $\omega_0$ is slightly passed. This case will be described below.

It is assumed that a periodic function x(t) with a fundamental frequency $f_0$ is analyzed using such a window function. The periodic function x(t) can be expressed as a Fourier series as follows.

[Math. 1]

$$x(t) = \sum_{k \in Z} X_k e^{j\frac{\omega k t}{T_0}} \tag{1}$$

Here, Z represents a set of all integers, and Xk generally becomes a complex number. In addition, $T_0=1/f_0$ represents a fundamental period.

A short term Fourier transform using a window function becomes a Fourier transform of a signal $s(t)=x(t)w(t-\tau)$ which is the product of the signal x(t) and the window function $w(t-\tau)$. When the window function is a function with time 0 as a center, τ represents the center time of a window at the time of analysis. If a Fourier transform of a window with time τ as a center is expressed by H(ω,τ) explicitly using the time as a parameter, H(ω,τ) is expressed as follows using H(ω).

$$H(\omega,\tau)=H(\omega)e^{-j\omega\tau} \tag{2}$$

A product in a time domain corresponds to convolution in a frequency domain by Fourier transform. Here, the Fourier transform of the signal x(t) is calculated.

[Math. 2]

$$X(\omega) = \sum_{k \in Z} X_k \delta(\omega - k\omega_0) \tag{3}$$

Here, δ(ω) is the Dirac delta function. X(ω) which is expressed as a train of delta functions arranged at regular intervals on the frequency axis is convolved on H(ω,τ) which is a Fourier transform of a window function set at the time τ, so a short term Fourier transform S(ω,τ) is obtained.

Meanwhile, H(ω) is set so as not to pass an angular frequency component higher than $\omega_0$. Therefore, when focusing on an angular frequency ω, S(ω,τ) is influenced by only two components of an angular frequency component closest to ω and a next closest angular frequency component. The two components are adjacent to each other, so with regard to the number representing a harmonic in the expression, if one component is even-numbered, the other component is odd-numbered.

Even when, for examination of the behavior of S(ω,τ), a Fourier transform X(ω) of a signal to be analyzed is a signal having two complex exponential functions with one coefficient of 1 as described below, loss of generality does not occur.

[Math. 3]

$$X(\omega)=\delta(\omega)+\alpha e^{j\beta}\delta(\omega-\omega_0) \tag{4}$$

This signal and the Fourier transform H(ω,τ) of the window function set at the time τ are convolved so as to obtain a spectrum S(ω,τ) depending on an analysis time. Here, H(ω,τ) is expressed by using H(ω) and a complex number representing a time delay.

[Math. 4]

$$S(\omega, \tau) = X(\omega) * H(\omega, \tau) = e^{-j\omega\tau}(H(\omega) + H(\omega - \omega_0)\alpha e^{j(\tau\omega_0+\beta)}) \quad (5)$$

Here, '*' represents convolution. The square of the absolute value of the spectrum $S(\omega,\tau)$ is calculated and arranged, such that a power spectrum is calculated as follows.

[Math. 5]

$$|S(\omega, \tau)|^2 = H^2(\omega) + \alpha^2 H^2(\omega - \omega_0) + 2\alpha H(\omega)H(\omega - \omega_0)\cos(\omega_0\tau + \beta) \quad (6)$$

The third term on the right side of this expression represents a component which sinusoidally changes depending on change in the time $\tau$ of the window.

Here, a case where a signal is selected after $H(\omega,\tau)$ is shifted by half of the fundamental period so as to calculate a power spectrum is taken into consideration. That is, a power spectrum is calculated using $H(\omega,\tau-T_0/2)$. After arrangement, the following expression is obtained.

[Math. 6]

$$|S(\omega, \tau + T_0/2)|^2 = H^2(\omega) + \alpha^2 H^2(\omega - \omega_0) - 2\alpha H(\omega)H(\omega - \omega_0)\cos(\omega_0\tau + \beta) \quad (7)$$

Here, if $|S(\omega,\tau)|^2$ and $|S(\omega,\tau+T_0/2)|^2$ are added, the following expression is obtained.

[Math. 7]

$$|S(\omega,\tau)|^2+|S(\omega,\tau+T_0/2)|^2=2(H^2(\omega)+\alpha^2H^2(\omega-\omega_0)) \quad (8)$$

The right side does not include the time $\tau$ at which the window is set. That is, even when analysis is conducted at any time, the same power spectrum can be calculated.

Next, an influence of an angular frequency higher than $\omega$ will be described. Substantially, the influence of those components is negligible. For example, for a hanning window which is widely used, when a hanning window is used in the method described herein, it is reasonable that the length of the window is two times larger than that of a signal to be analyzed. In this case, the minimum side lobe of the amplitude-frequency characteristic of the window is attenuated in inverse proportion to the third power of the frequency. The side lobe of the hanning window is attenuated which the polarity thereof alternately changes between positive and negative. In this case, however, taking into consideration of the worst condition, evaluation is done for a case where the side lobe has the same polarity. Given this perspective, in the case of a hanning window, the entire side lobe contributes such that the upper limit is suppressed by the limit of the following series.

[Math. 8]

$$c_0 + c_0\sum_{k=2}^{n}\frac{1}{k^3} \quad (9)$$

This value does not exceed $2C_0$. Here, $C_0$ represents an initial side lobe level. As a result, even in the worst case, an influence does not exceed −25 dB. When a harmonic is at the same level, there is an influence to such an extent to change the level of a harmonic of interest by about 0.5 dB. Such an influence is sufficiently smaller than temporal change in the spectrum of speech sound, and thus is substantially negligible. In the case of an actual signal, as described above, the polarities of the side lobe cancel each other, and components are generally different in phase, so there is a significantly smaller influence than the upper limit. In the case of a hanning window designed as such, since the amplitude-frequency characteristic shows that a zero point is at $kf_0/2$ (where k is an integer other than −1, 0, and 1), there is no error in the power spectrum of $n_1f_0/2$ (where $n_1$ is an integer).

The power spectrum acquisition unit 2 performs spectrum reconstruction to assure the positive definite property of the spectrum and also to assure consistency and optimality based on a way to think for a new sampling theorem. The new sampling theorem sees that sampling of an analog signal and reconstruction of an analog signal from a sample are combined. The sampling theorem will be described below.

Here, an intended system is first defined. Sampling is an operation to discretely extract an unknown input signal (function) $f\epsilon H$ processed by a function for analysis with a function $\phi_1(t)$ as an impulse response. Reconstruction from an analog signal from a sample is an operation to process a delta function with integration as a sample value by a function for synthesis with a function $\phi_2(t)$ as an impulse response.

After sampling and restoration from a sample are defined described as above, the sampling theorem is reformulated. First, a cross correlation function $a_{12}(k)$ of a function of analysis and synthesis is calculated.

[Math. 9]

$$a_{12}(k)=\langle\phi_1(t-k),\phi_2(t)\rangle \quad (10)$$

$\langle a(t),b(t)\rangle$ represents an inner product of a(t) and b(t), and is defined as follows.

[Math. 10]

$$\langle a,b\rangle=\int_{-\infty}^{\infty}b^*(t)a(-t)dt \quad (11)$$

Under these preparations, the following sampling theorem is established.

An unknown input signal (function) $f\epsilon H$ is considered. Here, if it is assumed that there is m>0 such that $|A_{12}(e^{j\omega})|>m$ is satisfied, an element f of $V(\phi_2)$ which is approximation of f satisfying consistency is uniquely determined from a viewpoint of the following expression.

[Math. 11]

$$\forall f\epsilon H, c_1(k)=\langle f,\phi_1(x-k)\rangle=\langle \tilde{f},\phi_1(x-k)\rangle \quad (12)$$

Here, the following expression is established. $V(\phi_2)$ represents a vector space extended by $\phi_2$.

[Math. 12]

$$A_{12}(e^{j\omega}) = \sum_{k\epsilon Z} a_{12}(k)e^{-j\omega k} \quad (13)$$

$c_1(k)$ is a series of sample values obtained by sampling. Short term Fourier transform is equivalent to filter processing in which a complex exponential function having a window function as an envelope is an impulse response, and analysis can be done that a spectrogram represents a sample value from filter processing in which the square of the window function is the function $\phi_1$ for analysis. A usual spectrogram corresponds to a case where $c_1(k)$ is observed as it is. An object is to ensure such that $c_1(k)$ which is the same result as that obtained when the original function f is obtained using $c_1(k)$ when an approximation function f is restructured and analyzed using a function for analysis in the same manner. This is consistent sampling.

It should be noted that a power spectrum of a periodic signal is expressed by Expression 8. This means that a power spectrum by a TANDEM window is expressed as the convolution of the square of an absolute value of an amplitude-frequency characteristic of a window function and two adjacent delta functions. To eliminate the influence of the periodicity, a rectangular smoothing function may be used in which the size of a base is equal to the fundamental frequency. With regard to calculation using a rectangular smoothing function, even when smoothing is not actually performed, calculation can be easily done from a cumulative sum and linear interpolation. Thus, processing satisfying the above-described sampling theorem can be obtained by the following procedure.

1. A correlation function between a function for analysis and a function for synthesis is calculated, and correction coefficients satisfying the above-described sampling theorem are obtained.

2. A signal is analyzed by a TANDEM window, and a power spectrum is obtained.

3. A cumulative sum of power spectra is obtained.

4. A result of smoothing by a rectangular smoothing function is calculated on the basis of a difference in the cumulative sum between two frequencies obtained by linear interpolation of the cumulative sum.

5. A smoothed power spectrum is corrected using the correction coefficient.

When thus obtained spectrum is used for speech synthesis by a sinusoidal model, if the fundamental frequency is constant, a function for synthesis becomes a delta function. When an FIR (Finite Impulse Response) filter is created from a spectrum and used for synthesis, a power spectrum of a window function used for calculation of an FIR filter becomes a filter for synthesis. These values can be calculated in advance before analysis of each frame.

To assure a positive definite property of a corrected power spectrum, the following nature is used. A logarithmic function ln(x) is expressed as a power series of (x−1) by Taylor expansion around x=1. Here, when $\Delta x=(x-1)$ is sufficiently small, a higher order of term than a first-order term is negligible. That is, linear approximation can be done. When linear approximation is established, the above-described correction coefficient can be used as it is.

Strictly, a plurality of correction coefficients are required. However, for actual speech sound processing, it is not desirable to take into consideration the influence from a component farther away from an adjacent harmonic due to various kinds of adverse effects. Herein, a method will be suggested in which, when only an adjacent harmonic is corrected, a correction coefficient is obtained under the condition that an error at a node is minimized, such that the adverse effects are suppressed and a calculation time is shortened. Specifically, a modified correction coefficient obtained from a correction coefficient $q_k\{k\epsilon\{0,1\}\}$ is represented by a symbol with a horizontal bar on the character and obtained as follows. A minimization problem regarding the modified correction coefficient of $q_k$ is numerically resolved in advance such that, with regard to the result of convolution of a value obtained by adding $\phi_2$ weighted by the modified correction coefficient of $q_k$ and $\phi_1$, the square sum of the value at the node is minimized.

The modified correction coefficient of $q_k$ is expressed by:

[Math. 13]

$$\bar{q}_k \tag{14}$$

A modified correction coefficient of $q_0$ is calculated by:

[Math. 14]

$$\bar{q}_0=1-2\bar{q}_1 \tag{15}$$

The modified correction coefficients may not be calculated every time.

Expression 16 specifically represents the procedure of 3, 4, and 5 among the above-described procedure of 1 to 5 using expressions. $P_T(\omega)$ is a power spectrum obtained by a TANDEM window, and $C(\omega)$ is a cumulative sum of power spectra. The upper limit and the lower limit of a cumulative integration range are extended by $2\omega_0$ with respect to the range of the Nyquist frequency from 0. Expression 16 represents a method in which a value from the result of convolution of a rectangular function having a width of a fundamental angular frequency $\omega_0$ and a power spectrum obtained by a TANDEM window by logarithmic transformation is calculated using the cumulative sum of the power spectra. The values at two angular frequencies farther away from the cumulative sum of the power spectra by $\omega_0$ are read strictly using linear interpolation, and a value at a low frequency is obtained from a value at a high angular frequency, such that the same result as that when convolution is conducted is obtained. This value is subjected to logarithmic transformation so as to obtain a smoothed spectrum $L_s(\omega)$ represented in a logarithmic domain. The last expression in Expression 16 provides a specific method in which the smoothed spectrum is combined using the modified correction coefficient of the correction coefficient $q_0$ and the modified correction coefficient of $q_1$, and a corrected logarithmic spectrum is obtained and subjected to exponential transformation, thereby obtaining a corrected smoothed power spectrum with a positive value guaranteed.

[Math. 15]

$$\begin{aligned} C(\omega) &= \int_{\omega L}^{\omega U} P_T(\omega)d\omega \\ L_s(\omega) &= \ln[C(\omega+\omega_0/2)-C(\omega-\omega_0/2)] \\ P_{TST}(\omega) &= e^{[\bar{q}_1 L_S(\omega-\omega_0)+L_S(\omega+\omega_0)+\bar{q}_0 L_S(\omega)]} \end{aligned} \tag{16}$$

It is assumed that speech sound is synthesized using an impulse response of a minimum phase from a spectrum section selected from a spectrogram. In this case, attenuation vibration corresponding to each pole is exponentially attenuated. A response in a domain where there is no pole becomes the duration of a window function for analysis and also becomes the response of the square of a window. This corresponds to the function for synthesis for the above-described sampling theorem.

Next, the configuration of the power spectrum acquisition unit 2 will be described with reference to FIGS. 2 to 4. The power spectrum acquisition unit 2 is divided into first to third portions 11 to 13 in order of the flow of processing. FIG. 2 shows a first portion 11. FIG. 3 shows a second portion 12. FIG. 4 shows a third portion 13. The second and third portions 12 and 13 form a spectrogram acquisition unit.

The first portion 11 includes a delay unit 21, first and second window processing units 22 and 23, first and second power spectrum calculation units 24 and 25, and a power spectrum addition unit 26. The delay unit 21 delays an input signal by a time set in advance, and provides the delayed input signal to the second window processing unit 23. The input signal is provided to the delay unit 21 and the first window processing unit 22 simultaneously. The input signal provided to the periodic signal conversion device 1 is provided to the first and second window processing units 22 and 23. At this time, the input signal which is provided to the second window processing unit 23 can be delayed by the delay unit 21 by a time set in advance with respect to the input signal which is provided to the first window processing unit 22. The lag of the input signal by the delay unit 21 is ½ of the fundamental period $T_0$. Information regarding the fundamental period is provided from the fundamental period calculation unit 3, and the delay unit 21 determines the lag in accordance with information regarding the fundamental period provided from the fundamental period calculation unit 3. The delay unit 21 and the first and second window processing units 22 and 23 form an extraction unit.

The first and second window processing units 22 and 23 cut part of the provided input signal by a hanning window. A signal cut by the first window processing unit 22 is provided to the first power spectrum calculation unit 24, and a signal cut by the second window processing unit 23 is provided to the second power spectrum calculation unit 25. The length of the hanning window is selected as two times larger than the fundamental period $T_0$. Information regarding the fundamental period is provided from the fundamental period calculation unit 3, the first and second window processing units 22 and 23 determine the length of the hanning window in accordance with information regarding the fundamental period provided from the fundamental period calculation unit 3.

In the first and second power spectrum calculation units 24 and 25, a power spectrum of a speech sound waveform is calculated by FFT (Fast Fourier Transform). A harmonic structure due to periodicity of speech sound is observed from the power spectrum. The first and second power spectrum calculation units 24 and 25 form a calculation unit.

Figure 7:
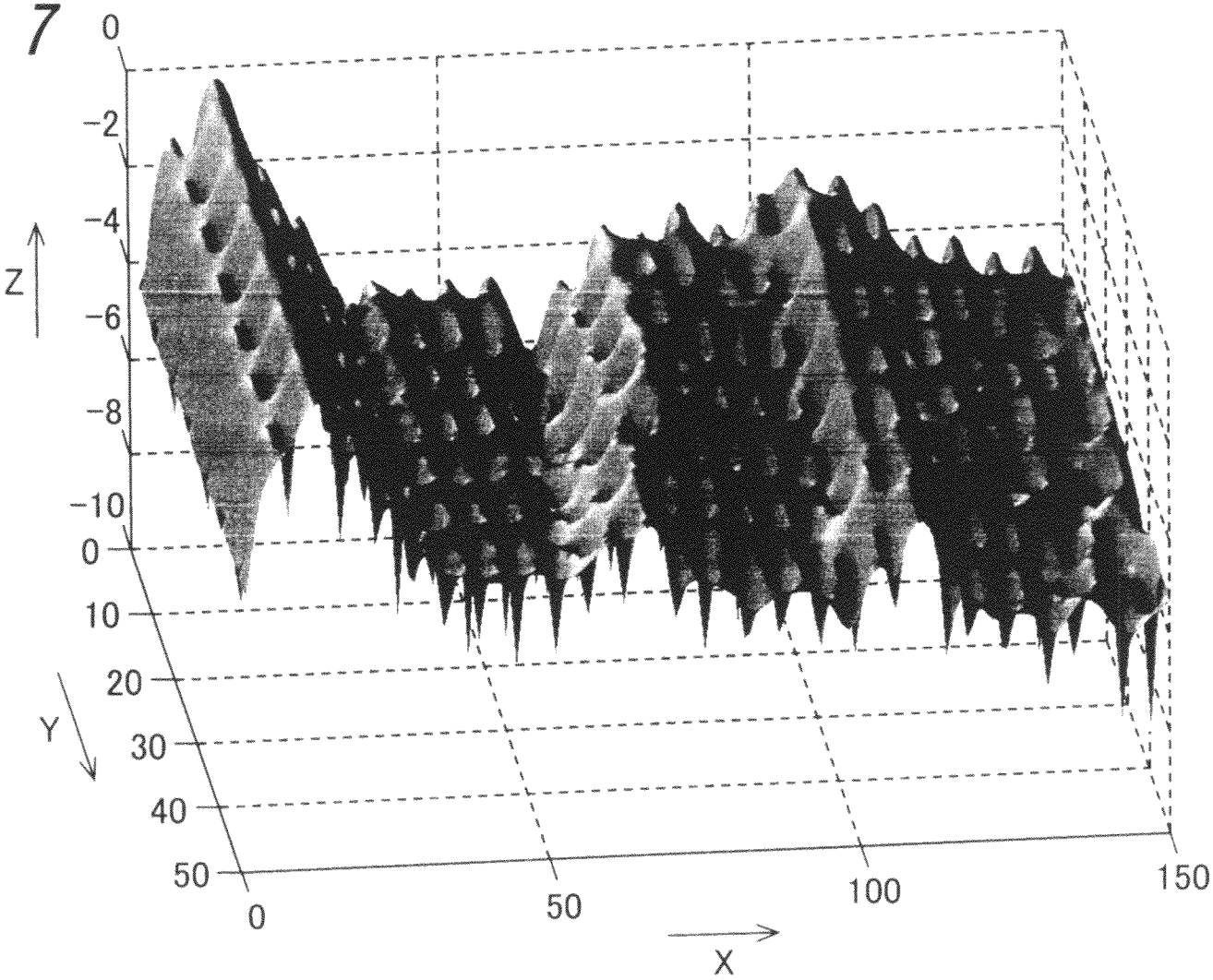
FIG. 7 is a graph showing an example of power spectra obtained by first and second power spectrum calculation units 24 and 25.

FIG. 7 is a graph showing an example of power spectra obtained by the first and second power spectrum calculation units 24 and 25. In the graph of FIG. 7, the X axis represents time, the Y axis represents a frequency, and the Z axis represents intensity using logarithmic representation (decibel representation). The unit of each axis is arbitrary.

The power spectra calculated by the first and second power spectrum calculation units 24 and 25 are provided to the power spectrum addition unit 26. The power spectrum addition unit 26 adds the power spectra provided from the first and second power spectrum calculation units 24 and 25, and outputs an added power spectrum (output power spectrum). The power spectrum addition unit 26 forms an addition unit.

Figure 8:
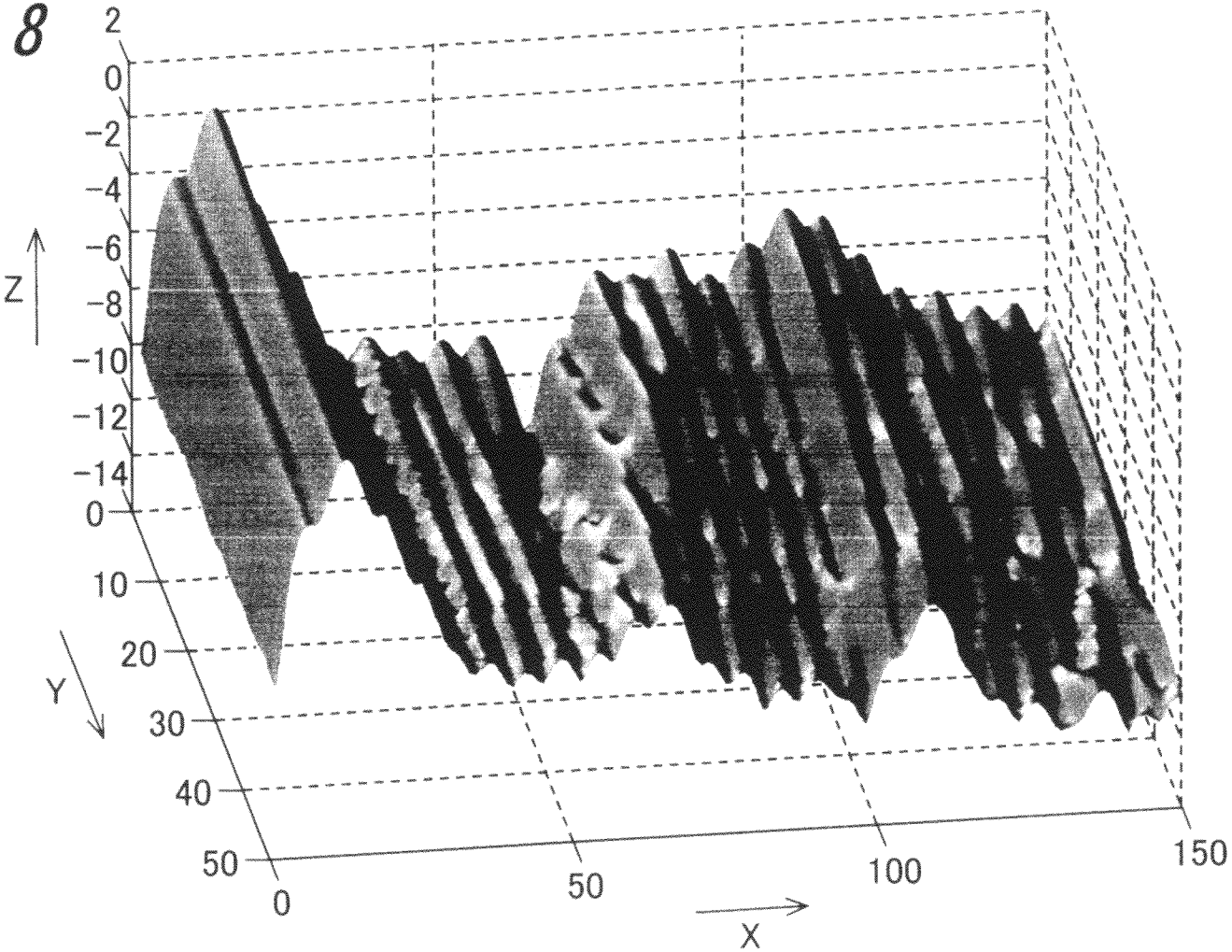
FIG. 8 is a graph showing an example of an output power spectrum outputted from a power spectrum addition unit 26.

FIG. 8 is a graph showing an example of an output power spectrum outputted from the power spectrum addition unit 26. In the graph of FIG. 8, the X axis represents a frequency, the Y axis represents time, and the Z axis represents intensity using logarithmic representation (decibel representation). The unit of each axis is arbitrary.

The output power spectrum is provided to the second portion 12. The second portion 12 includes a cumulative power spectrum calculation unit 31, first and second smoothed spectrum calculation units 32 and 33, logarithmic transformation units 34 and 35, and an optimum frequency compensation integration unit 36. The output power spectrum is provided to the cumulative power spectrum calculation unit 31. The cumulative power spectrum calculation unit 31 calculates a cumulative sum of the provided output power spectra. The cumulative sum of the output power spectra is provided to the first and second smoothed spectrum calculation units 32 and 33.

For a pair of different frequencies by a fundamental angular frequency, the first and second smoothed spectrum calculation units 32 and 33 calculate smoothed spectra corresponding to the result of convolution of a rectangular function from the value of the cumulative power spectra at angular frequencies at an interval of a fundamental angular frequency around the respective angular frequencies.

Figure 9:
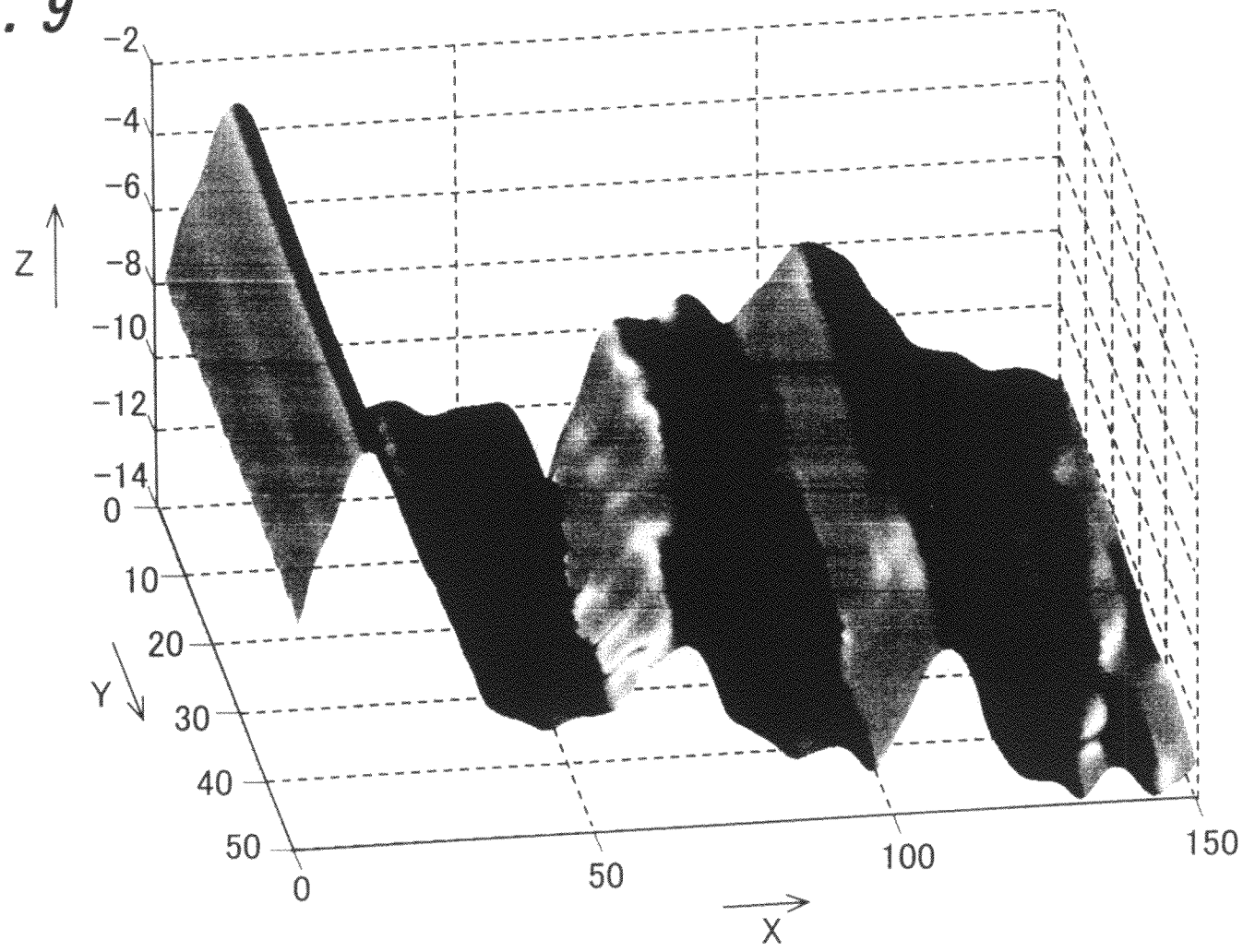
FIG. 9 is a graph showing examples of power spectra outputted from first and second smoothed spectrum calculation units 32 and 33.

FIG. 9 is a graph showing examples of power spectra outputted from the first and second smoothed spectrum calculation units 32 and 33. In the graph of FIG. 9, the X axis represents a frequency, the Y axis represents time, and the Z axis represents intensity using logarithmic representation (decibel representation). The unit of each axis is arbitrary.

The first and second logarithmic transformation units 34 and 35 perform logarithmic transformation of the values of the calculated smoothed spectra.

The optimum frequency compensation integration unit 36 synthesizes the values of the smoothed spectra logarithmically transformed by the first and second logarithmic transformation units 34 and 35 using an optimum correction coefficient, and outputs an optimum frequency smoothed logarithmic power spectrum.

Figure 10:
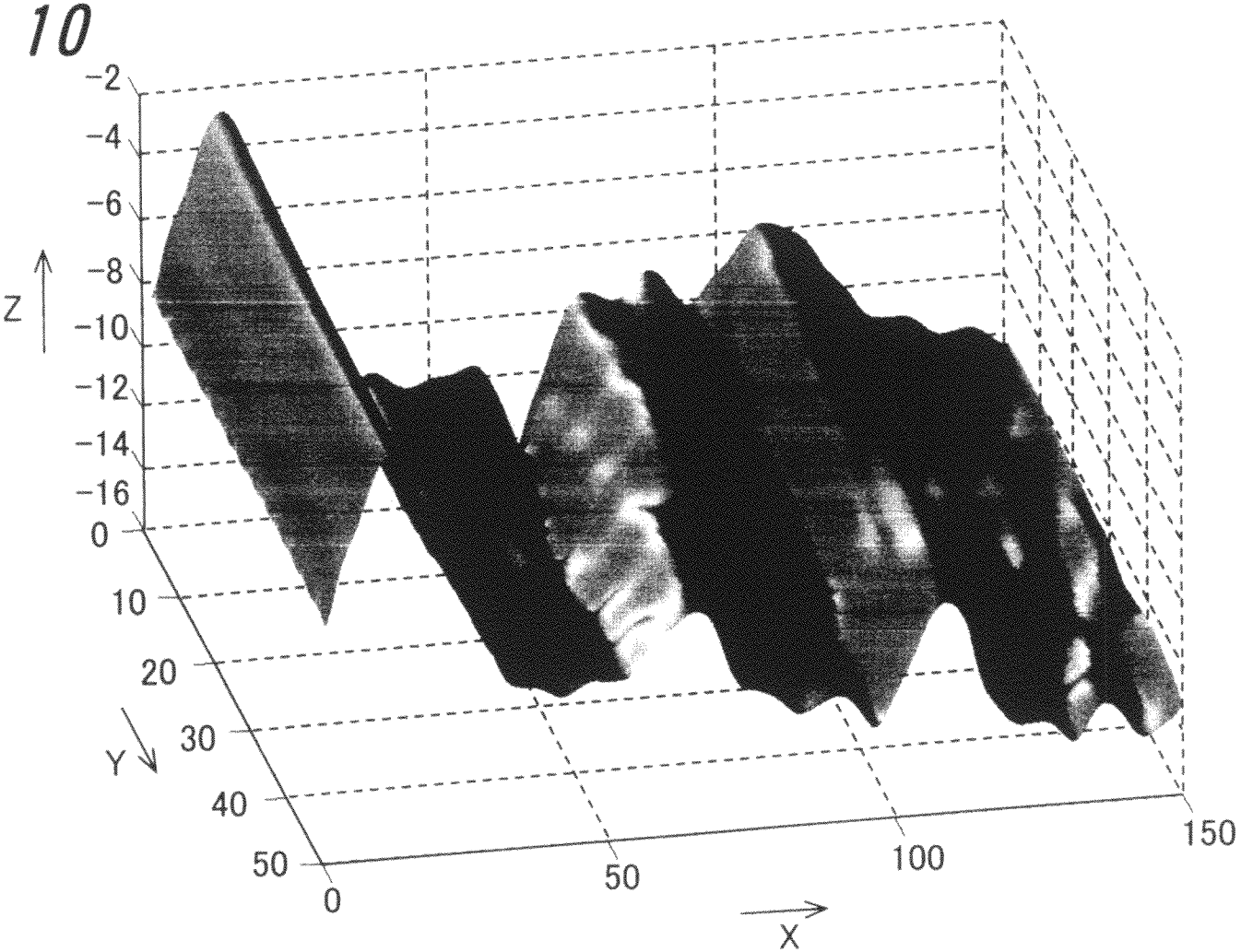
FIG. 10 is a graph showing an example of an optimum frequency smoothed logarithmic power spectrum outputted from an optimum frequency compensation integration unit 36.

FIG. 10 is a graph showing an example of an optimum frequency smoothed logarithmic power spectrum outputted from the optimum frequency compensation integration unit 36. In the graph of FIG. 10, the X axis represents a frequency, the Y axis represents time, and the Z axis represents intensity using logarithmic representation (decibel representation). The unit of each axis is arbitrary.

The optimum frequency smoothed logarithmic power spectrum is provided to the third portion 13. The third portion 13 includes a three-frame accumulation unit 41, an optimum time compensatory synthesis unit 42, a logarithmic transformation unit 43, and first and second accumulation units 44 and 45.

The three-frame accumulation unit 41 accumulates optimum frequency smoothed logarithmic power spectra at three points of time temporally spaced at the fundamental period.

The optimum time compensatory synthesis unit 42 provides a calculated optimum time frequency smoothed logarithmic power spectrum to the logarithmic transformation unit 43 and the first accumulation unit 44.

The logarithmic transformation unit 43 performs exponential transformation on the optimum time frequency smoothed logarithmic power spectrum, and outputs an optimum time frequency smoothed power spectrum.

The first accumulation unit 44 accumulates the optimum time frequency smoothed logarithmic power spectra, and outputs an optimum time frequency smoothed logarithmic power spectrogram.

The second accumulation unit 45 accumulates the optimum time frequency smoothed power spectrum, and outputs an optimum time frequency smoother logarithmic power spectrogram.

The power spectrum acquisition unit 2 performs the above-described signal processing for every fundamental period. FIGS. 7, 8, 9, and 10 show the calculation result for every 1 ms for ease of understanding of the method. With regard to the value during inter-processing, one obtained by linear interpolation of a value obtained by processing may be used.

Returning to FIG. 1, the fundamental period calculation unit 3 extracts the fundamental period $T_0$ of the signal from the period of the speech sound waveform shown in FIG. 5. For example, the fundamental period calculation unit 3 extracts the fundamental period of the signal for every 1 ms. In the fundamental period calculation unit 3, an auto-correlation function of a waveform is calculated, and the fundamental period $T_0$ is extracted as a time interval which provides the maximum value of the auto-correlation function. Alternatively, an instantaneous frequency of a signal extracted by using a filter which separates a fundamental component is calculated, and the fundamental period $T_0$ is extracted as the reciprocal of the instantaneous frequency.

The optimum time frequency smoothed power spectrum obtained by the power spectrum acquisition unit 2 is provided to the smoothed spectrum conversion unit 4. In the smoothed spectrum conversion unit 4, to create an impulse response v(t) of a minimum phase, a smoothed spectrum S(ω) is converted into V(ω). To manipulate a tone, the smoothed spectrum is manipulated and modified for any purpose, so a modified smoothed spectrum Sm(ω) is obtained.

In the following description, the modified smoothed spectrum Sm(ω) as well as the smoothed spectrum are represented by "S(ω)".

In the smoothed spectrum conversion unit 4 and the sound source information conversion unit 5, sound source information is converted for any purpose, together with conversion in the smoothed spectrum conversion unit 4. In the sound source information conversion unit 5, the frequency axis in obtained speech sound parameters (smoothed spectrum and fine fundamental period information) is compressed in order to change the nature of a voice of a speaker (for example, to change a female voice to a male voice), or a fine fundamental period is multiplied by an appropriate factor in order to change the pitch of the voice. As described above, changing the speech sound parameters for any purpose is conversion of speech sound parameters. Various kinds of speech sound can be created by adding a manipulation to the speech sound parameters (smoothed spectrum and fine fundamental period information).

The phase adjustment unit 6 performs processing for manipulating a period with resolution higher than the sampling period using spectrum information and sound source information converted by the smoothed spectrum conversion unit 4 and the sound source information conversion unit 5. That is, a temporal position where an intended waveform is set is calculated in terms of a sampling period ΔT. The result is divided into an integer portion and a real number portion, and a phasing component Φ1(ω) is produced using the real number portion. Then, the phase of S(ω) or V(ω) is adjusted.

The waveform synthesis unit 7 produces a synthesized waveform using the smoothed spectrum phased by the phase adjustment unit 6 and the sound source information converted by the sound source information conversion unit 5. The phase adjustment unit 6 and the waveform synthesis unit 7 produces a sound source waveform from the smoothed spectrum for every period determined from the fine fundamental period, and adds up created sound source waveforms while shifting the time axis, thereby creating a speech sound resulting from transformation. That is, speech sound synthesis is conducted. The time axis cannot be shifted at a precision finer than the sampling period determined based on the sampling frequency upon digitizing the signal. For the fractional amount (below the decimal point) of the accumulated fundamental periods in terms of the sampling period, a term having a gradient based on the fractional time with linear phase change with respect to a frequency is added to a calculated value Φ1(ω), such that the control of the fundamental period with resolution finer than that determined by the fundamental period is enabled.

A sound source waveform may be produced from the smoothed spectrum for every period determined from the fine fundamental period, and created sound source waveforms may be added up while shifting the time axis, thereby creating speech sound resulting from transformation.

As described above, in the periodic signal conversion device 1, a spectrogram can be obtained by simple processing, and complex calculation and parameter adjustment are not required, or only an extremely limited number of parameters may be set. Therefore, design can be easily performed for any purpose, and only functions capable of being simply calculated can be used, such that a spectrogram can be obtained in short time and simply without depending on an analysis time. A further smoothed spectrogram in the frequency direction and the temporal direction can be obtained, and the signal intensity in the frequency direction can be smoothed so as to reduce noise. A periodic signal is converted into a different signal using the further smoothed spectrogram. For this reason, the influence of the periodicity in the frequency direction and the temporal direction is reduced. Therefore, the temporal resolution and the frequency resolution can be determined in a well balanced manner.

Although in this embodiment, the periodic signal processing method is used for synthesis of speech signals, signals for use in the periodic signal processing method of the invention are not limited to speech signals. For this reason, various audio signals which are obtained by echo examination or the like may be used. The same effects can be achieved for processing of signals which are not limited to voices.

Although in this embodiment, the power spectrum acquisition unit 2 includes the first to third portions 11 to 13, the power spectrum acquisition unit 2 may include only the first portion 11, or only the first and second portions 11 and 12. With such a configuration, the original object can be achieved.

Although in this embodiment, a hanning window is used as a window function, a window obtained by convolving a hanning window and a Bartlett window may be used. In this case, the length of Bartlett window may be two times larger than the fundamental period, such that the length of the hanning window may be the same as the fundamental period. The length of the Bartlett window and the length of the hanning window are both two times larger than the fundamental period, so the temporal change can be further reduced. In this case, however, the performance which follows fine change in the temporal direction is lowered.

Figure 11:
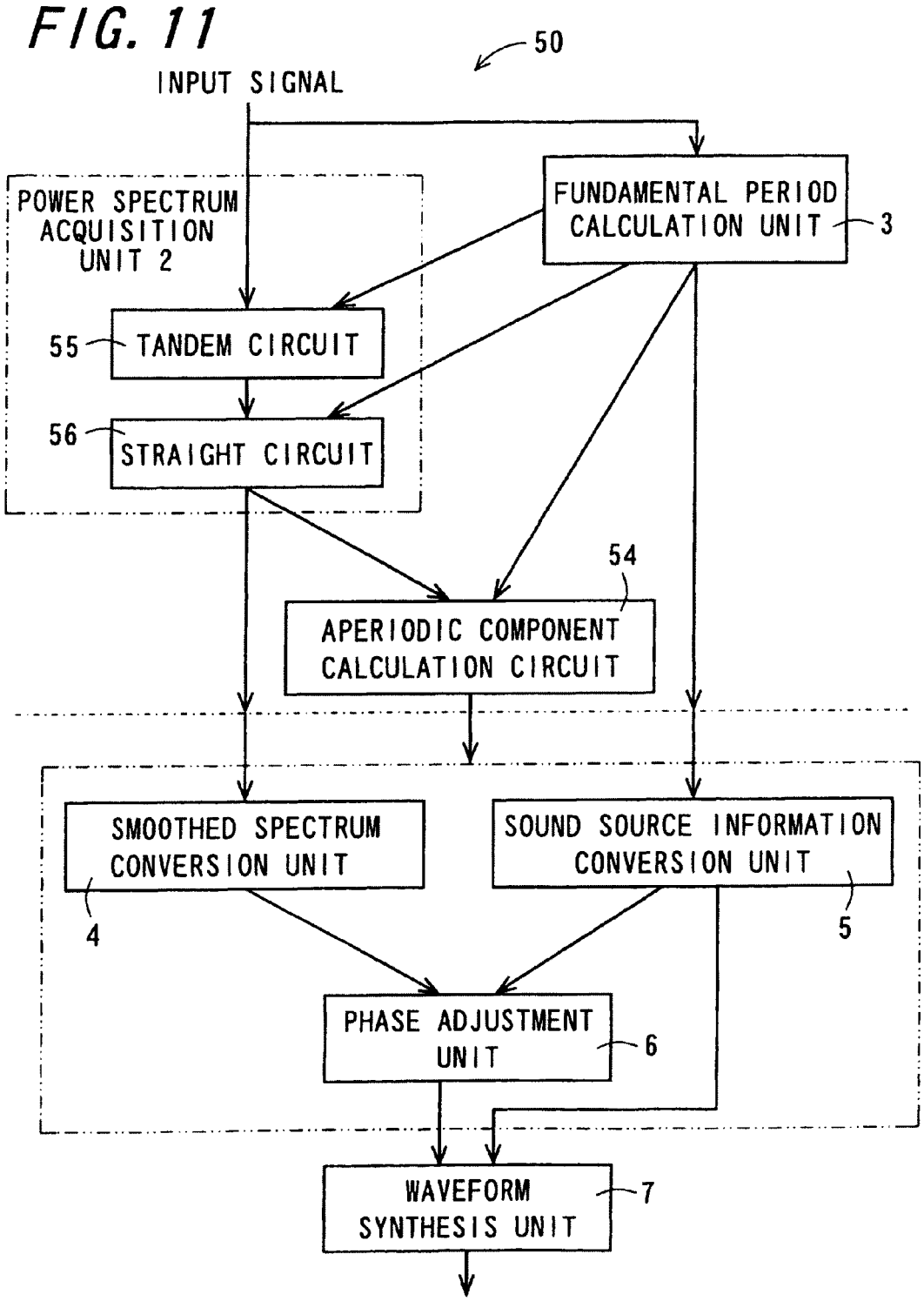
FIG. 11 is a schematic block diagram showing a periodic signal conversion device 50 for realizing a speech conversion method according to another embodiment of the invention.

FIG. 11 is a schematic block diagram showing a periodic signal conversion device 50 for realizing a speech conversion method according to another embodiment of the invention. In this embodiment, the portions corresponding to the configuration of the periodic signal conversion device 1 of the above-described embodiment are represented by the same reference numerals, and description thereof may not be repeated. The speech conversion method of this embodiment includes a periodic signal processing method and a periodic signal analysis method. A processing circuit executes a predetermined program, thereby realizing the periodic signal conversion device 50.

The periodic signal conversion device 50 is basically configured such that an aperiodic component calculation circuit 54 is added to the configuration of the periodic signal conversion device 1. The periodic signal conversion device 50 includes a power spectrum acquisition unit 2, a fundamental period calculation unit 3, a smoothed spectrum conversion unit 4, a sound source information conversion unit 5, a phase adjustment unit 6, a waveform synthesis unit 7, and an aperiodic component calculation circuit 54. The power spectrum acquisition unit 2 and the fundamental period calculation unit 3 are different from those in the periodic signal conversion device 1. The processing circuit executes predetermined programs, thereby realizing the functions of the respective units.

The power spectrum acquisition unit 2 arranges time windows such that a center of each of the time windows is at a division position which divides a fundamental frequency in a temporal direction into fractions 1/n (where n is an integer equal to or larger than 2) so as to extract a plurality of portions of different ranges from a signal having periodicity, calculates a power spectrum for the plurality of portions extracted by the respective time windows, and adds the calculated power spectrum with the same ratio. The power spectrum acquisition unit 2 obtains a spectrogram on the basis of a cumulative sum of the added power spectra in the frequency direction. That is, the center positions of adjacent time windows in the temporal direction are spaced at a distance of 1/n (where n is an integer equal to or larger than 2) of the fundamental period in the temporal direction. Although in the power spectrum acquisition unit 2 of the above-described embodiment, n is selected as 2, n is not limited to 2.

The power spectrum acquisition unit 2 includes a TANDEM circuit 55 and a STRAIGHT circuit 56.

Figure 12:
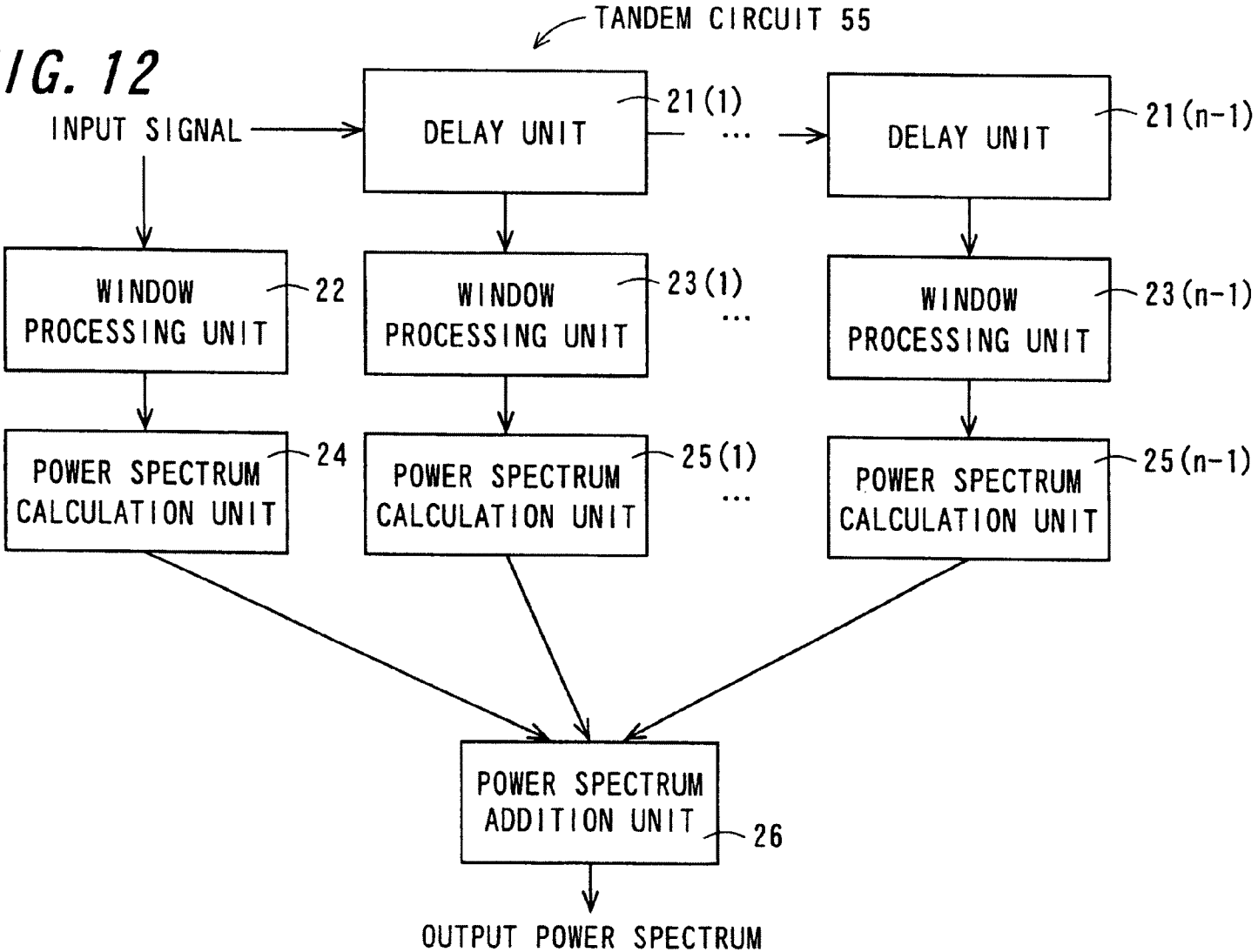
FIG. 12 is a schematic block diagram showing the configuration of a TANDEM circuit 55.

FIG. 12 is a schematic block diagram showing the configuration of the TANDEM circuit 55. The TANDEM circuit 55 is the same as the first portion 11 of the above-described power spectrum acquisition unit 2, and includes (n−1) delay units 21, (n−1) second window processing units 23, and (n−1) second power spectrum calculation units 25. The delay units 21, the second window processing units 23, and the second power spectrum calculation units 25 are appended with suffixes (1) to (n−1). The lag of the input signal by each of the delay units 21(1) to 21(*n*−1) is 1/n of the fundamental period $T_0$.

When N is equal to or larger than 3, the input signal provided to the delay unit 21(*k*1) is delayed by the delay unit 21(*k*1) by 1/n of the fundamental period $T_0$ and then provided to the delay unit 21(*k*1+1). Here, k1 is a natural number. The input signal provided to the delay unit 21(*k*1) is provided to the second window processing unit 23(*k*1) and cut, and a power spectrum is calculated by the second power spectrum calculation unit 25(*k*1).

The power spectra calculated by the first and second power spectrum calculation units 24 and 25(1) to 25(*n*−1) are provided to the power spectrum addition unit 26. The power spectrum addition unit 26 adds the power spectra, and outputs an added power spectrum (output power spectrum). The output power spectrum is provided to the STRAIGHT circuit 56.

The STRAIGHT circuit 56 performs selective smoothing on the frequency axis for a power spectrum (TANDEM spectrum) which does not depend on an analysis position calculated on the basis of the fundamental period $T_0$, generates a power spectrum (STRAIGHT spectrum) in which there is no influence of interference due to periodicity, and outputs the power spectrum. The STRAIGHT circuit 56 includes the cumulative spectrum calculation unit 31 and the smoothed spectrum calculation unit 32 of the second portion 12 shown in FIG. 3.

Figure 13:
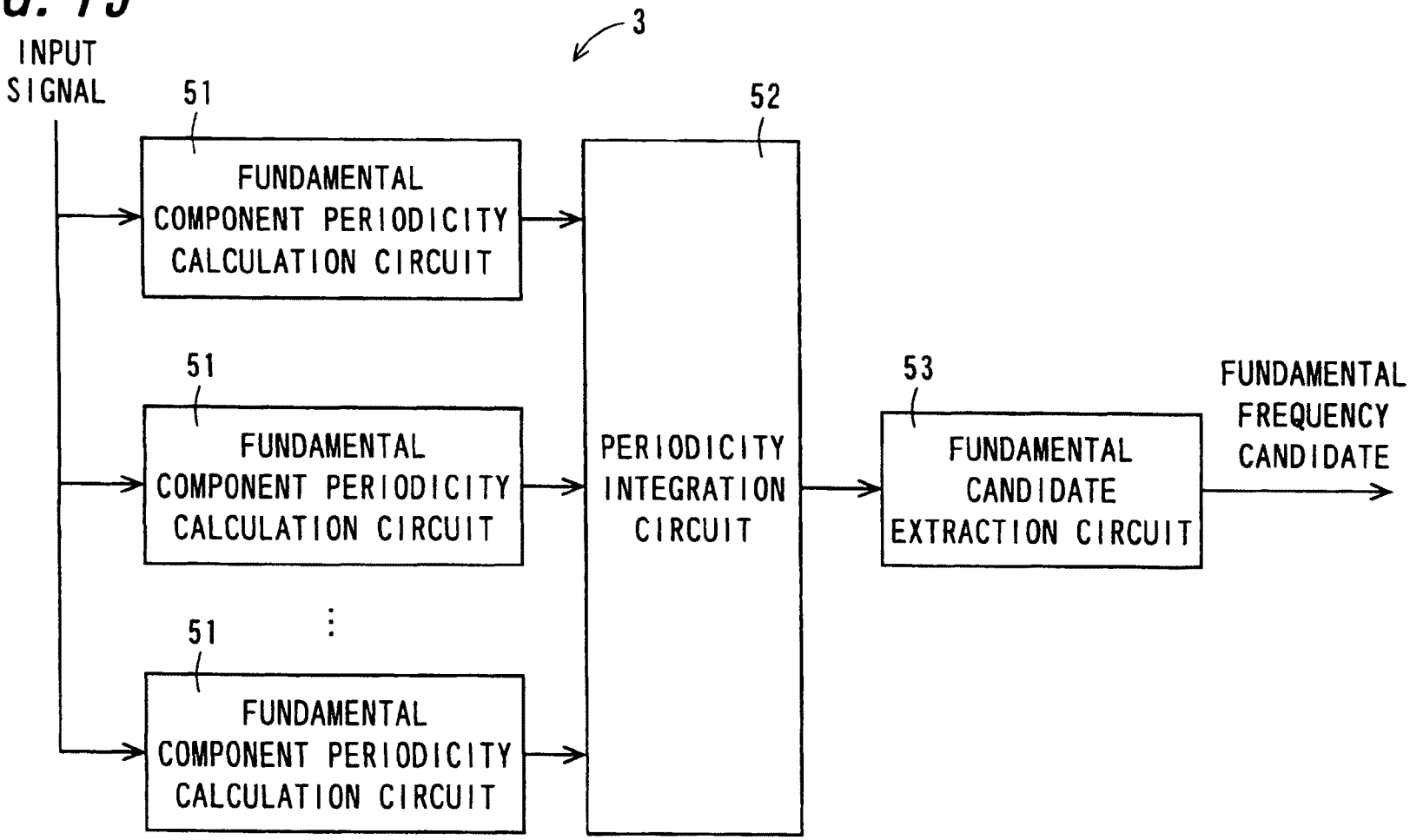
FIG. 13 is a schematic block diagram showing the configuration of a fundamental period calculation unit 3.

FIG. 13 is a schematic block diagram showing the configuration of the fundamental period calculation unit 3. The fundamental period calculation unit 3 includes a plurality of fundamental component periodicity calculation circuits 51, a periodicity integration circuit 52, and a fundamental candidate extraction circuit 53. The fundamental period calculation unit 3 calculates the value of the fundamental period $T_0$. If the fundamental period $T_0$ is calculated, the fundamental frequency $f_0$ is calculated. In the fundamental period calculation unit 3, a number of candidates of the fundamental frequency (for example, for four octaves by two for every octave) are assumed, and for the candidates of the fundamental frequency, the evaluation values of the periodicity of the fundamental are calculated as the function of the fundamental period and synthesized, a candidate of a reliable fundamental which is not recognized as coincidence due to probabilistic fluctuation is analyzed and extracted, and the frequency is outputted as the candidate of the fundamental frequency. With regard to the candidates of the above-described fundamental frequency, for example, on the assumption that candidates for four octaves by two for every octave are provided, eight fundamental component periodicity calculation circuits 51 are prepared.

Figure 14:
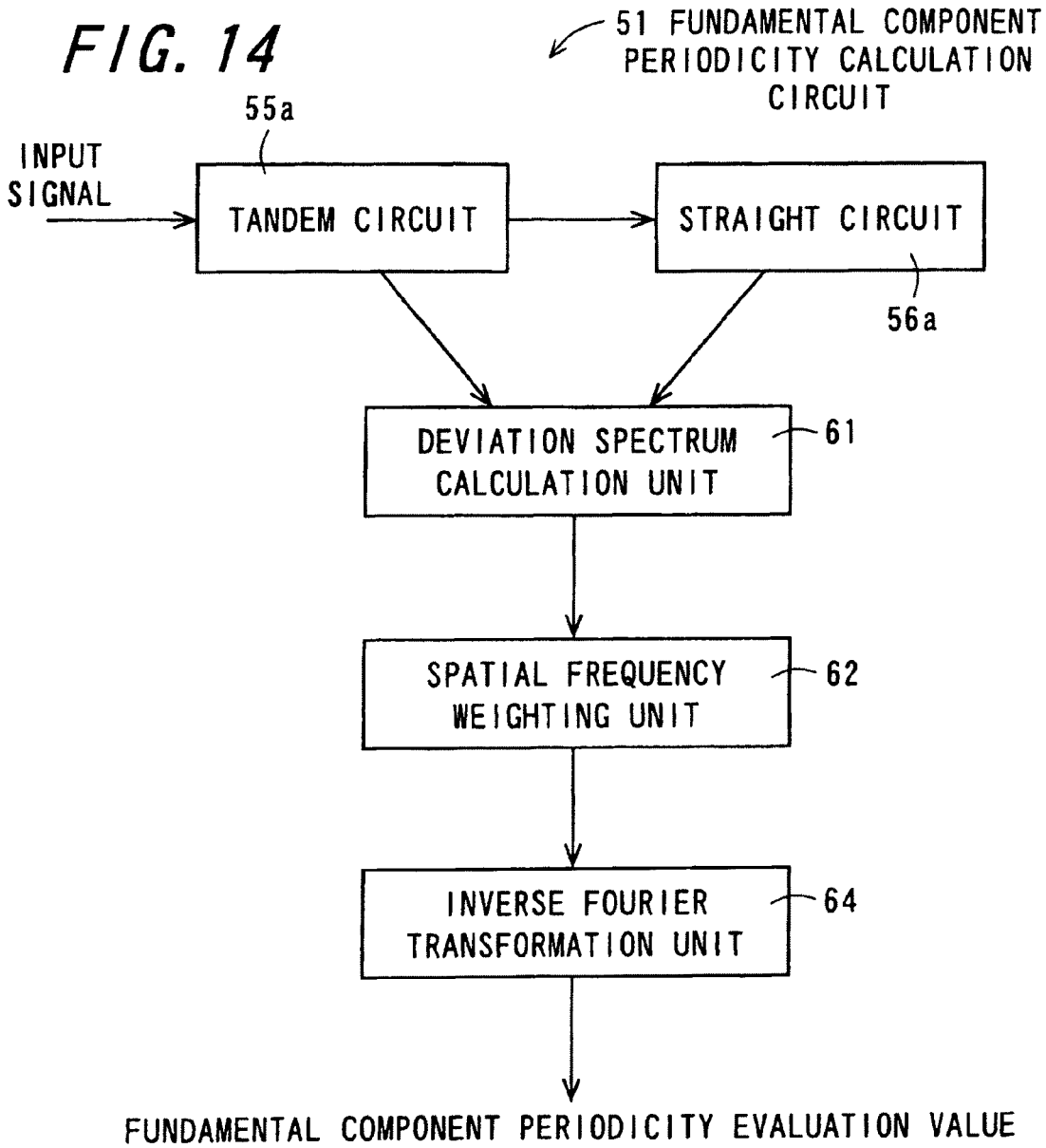
FIG. 14 is a schematic block diagram showing the configuration of a fundamental component periodicity calculation circuit 51.

FIG. 14 is a schematic block diagram showing the configuration of the fundamental component periodicity calculation circuit 51. The fundamental component periodicity calculation circuit 51 includes a TANDEM circuit 55*a*, a STRAIGHT circuit 56*a*, a deviation spectrum calculation unit 61, a spatial frequency weighting unit 62, and an inverse Fourier transformation unit 64. The TANDEM circuit 55*a* has the same configuration as the above-described TANDEM circuit 55, and the STRAIGHT circuit 56*a* has the same configuration as the above-described STRAIGHT circuit 56. The fundamental component periodicity calculation circuit 51 calculates the evaluation values (fundamental component periodicity evaluation values) of the periodicity of the fundamental as the function of the fundamental period for the candidates of the fundamental frequency.

The input signal is provided to the TANDEM circuit 55*a*, and a TANDEM spectrum outputted from the TANDEM circuit 55*a* is provided to the STRAIGHT circuit 56*a* and the deviation spectrum calculation unit 61. The STRAIGHT circuit 56*a* performs selective smoothing on the frequency axis for the provided TANDEM spectrum to generate a STRAIGHT spectrum and outputs the generated STRAIGHT spectrum to the deviation spectrum calculation unit 61. The candidates of the fundamental frequency assumed in advance are provided to the TANDEM circuit 55*a* and the STRAIGHT circuit 56*a*. As described above, when it is assumed that the candidates of the fundamental frequency are for four octaves by two for every octave, eight fundamental frequencies are selected within the range of the four octaves such that a difference on a logarithmic frequency from an adjacent fundamental frequency is at a regular interval, and the fundamental frequencies are respectively provided to a plurality of fundamental component periodicity calculation circuits 51.

The deviation spectrum calculation unit 61 divides the TANDEM spectrum provided by the TANDEM circuit 55*a* by the STRAIGHT spectrum provided by the STRAIGHT circuit 56*a*, and subtracts a numerical value "1" from the result. The TANDEM spectrum is divided by the STRAIGHT spectrum at each frequency and 1 is subtracted from the result, such that a deviation spectrum representing only change associated with periodicity can be calculated.

If the output (deviation spectrum) from the deviation spectrum calculation unit 61 is Pc(ω), Pc(ω) is expressed by Expression 17.

[Math. 16]

$$Pc(\omega) = \frac{P_T(\omega)}{P_{TST}(\omega)} - 1 \tag{17}$$

In Expression 17, $P_T(\omega)$ represents a TANDEM spectrum, and $P_{TST}(\omega)$ represents a STRAIGHT spectrum. $P_{TST}(\omega)$ is expressed by Expression (16).

In the deviation spectrum Pc(ω), a spatial frequency component corresponding to the fundamental frequency becomes dominant due to band limitation in the frequency direction by the window function and a relatively large positive bias term by the TANDEM window. In the case of an input signal such as actual speech sound, a power spectrum is not flat, and the fundamental frequency is not constant. The influence of the former is reflected in the STRAIGHT spectrum used for normalization, so it is negligible with first-order approximation. The influence of the latter is represented as amplitude modulation of Pc(ω) in the frequency direction. The modulated spatial frequency due to amplitude modulation is proportional to the difference in the fundamental frequency between points of time spaced by a time corresponding to half of the fundamental period. Because this amplitude modulation has the maximum value at frequency 0, the influence of this amplitude modulation is made effectively negligible in calculated Fourier transform by multiplying a frequency domain window $\omega_{\omega 0,N}(\omega)$, which centers at frequency 0 and attenuates toward higher frequency region.

The spatial frequency weighting unit 62 stores a weighting factor $\omega_{\omega 0,N}(\omega)$, and a low frequency component of Pc(ω) is selected. The low frequency component of Pc(ω) is selected such that, for example, about four harmonics are provided. $\omega_{\omega 0,N}(\omega)$ is set so as to satisfy the condition of Expression 18, and an example thereof is shown in Expression 19.

[Math. 17]

$$w_{\omega 0,N}(\omega) = \begin{cases} 0 & |\omega| > N\omega_0 \\ w_{\omega 0,N}(-\omega) & |\omega| \le N\omega_0 \end{cases} \tag{18}$$

$$\int_{-\infty}^{\infty} w_{\omega 0,N}(\omega) d\omega = 1$$

[Math. 18]

$$w_{\omega 0,N}(\omega) = c_0\left(1 + \cos\left(\pi \frac{\omega}{N\omega_0}\right)\right) \tag{19}$$

The inverse Fourier transformation unit 64 multiples Pc(ω) by the weighting factor $\omega_{\omega 0,N}(\omega)$ and, as shown in Expression 20, performs Fourier transform to calculate a periodic component A(τ) on the frequency axis. By the inverse Fourier transform, the fundamental component periodicity evaluation value is calculated as the function of the fundamental period.

[Math. 19]

$$A(\tau; T_0) = \int_{-\infty}^{\infty} w_{\omega 0,N}(\omega) Pc(\omega; T_0) e^{-j\omega\tau} d\omega \tag{20}$$

In Expression 20, Pc(ω) is represented as $Pc(\omega;T_0)$, and A(τ) is represented as $A(\tau;T_0)$, by explicitly indicating the fundamental period $T_0$ which is information necessary for designing a TANDEM window. Hereinafter, as occasion demands, a notation method is described. The inverse Fourier transformation unit 64 outputs the periodic component A(τ) as the fundamental component periodicity evaluation value. The fundamental component periodicity evaluation value is fed to the periodicity integration circuit 52.

Description will be provided with reference to FIG. 13 again. Since the fundamental frequency is unknown, an index is calculated by integrating values A(τ), which are calculated by fundamental component periodicity calculation circuits 51, by assuming hypothetical fundamental frequency for each fundamental component periodicity calculation circuit 51.

The synthesized periodic component is expressed by:

[Math. 20]

$$\overline{A}(\tau) \tag{21}$$

and a calculation expression is expressed by:

[Math. 21]

$$\overline{A}(\tau) = \frac{1}{M}\sum_{k=1}^{M} w_{LAG}\left(\tau; T_L 2^{\frac{1-k}{L}}\right) A\left(\tau; T_L 2^{\frac{1-k}{L}}\right) \tag{22}$$

Here, $T_L$ represents the maximum fundamental period of the initial fundamental period search reange, and L represents the number of assumed fundamental periods for each octave. Further, $w_{LAG}(\tau;Tc)$ is a single-peak weighting function in which the value becomes 1 in a period Tc. The peak of Expression 22 can be calculated by parabolic interpolation using three points including the peak on the basis of the fact that the shape near the peak can be approximated to a parabola.

The fundamental period is obtained by using the fact that Expression 21 which is the periodic component has the maximum value when τ=Tc. First, parameters for providing such a nature are determined. Inspecting the behavior of $A(\tau;T_0)$ on the assumption of a fundamental period Tc, it is found that $A(\tau;T_0)$ calculated on the assumption of Tc extracts change of a power spectrum on the frequency axis due to a random component other than an intended component for extraction. The size of the time window for use in TANDEM analysis is set such that the S/N ratio between the unnecessarily extracted component and the intended periodic component is maximized. Specifically, when a Blackman window is used, the S/N ratio is maximized when the length of the window is four times larger than the assumed period Tc. Under this condition, the weighting function $w_{LAG}(\tau;Tc)$ is designed. The aim of design resides in suppression of unnecessary peaks due to side lobes of original window and peaks due to nonlinear distortion in the spatial frequency component on the power spectrum caused by the use of a too long time window, by using the weighting function $w_{LAG}(\tau;Tc)$. At the time of selection of a weighting function, it is necessary to take into consideration the conditions that the integrated result by Expression 20 is not significantly varying along the frequency direction, and the number of bands to be arranged is not extremely large. Here, Expression 23 is shown as a specific function. The arrangement density of the bands is such that two bands are arranged for every octave. The support of the function in Expression 23 have a width of two octaves and sufficiently overlap each other.

[Math. 22]

$$w_{LAG}(\tau; T_0) = 0.5 + 0.5\cos\left(\pi \log_2\left(\frac{\tau}{T_0}\right)\right) \tag{23}$$

Figure 15:
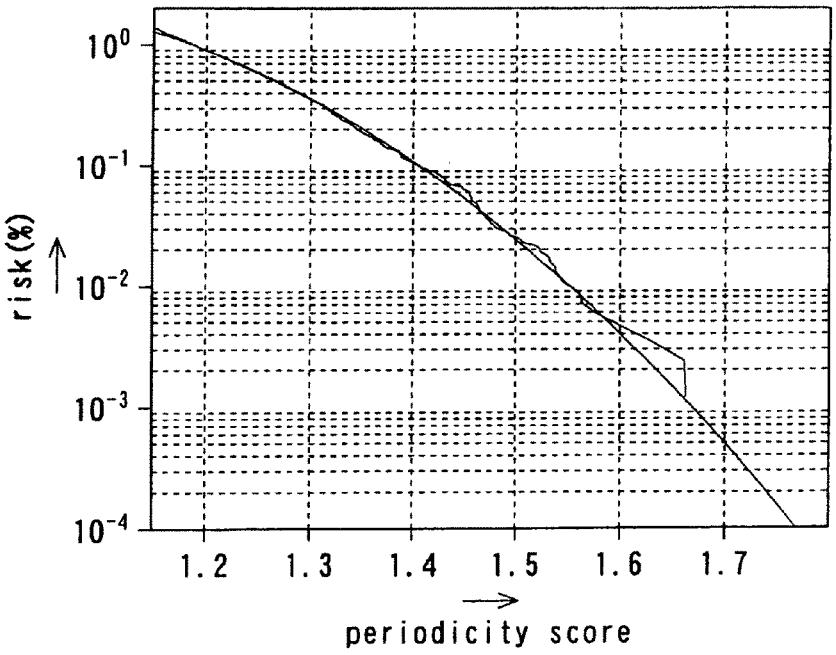
FIG. 15 shows an example of a graph where a peak occurrence probability is expressed as a function of a peak value.

The peak distribution of Expression 21 finally calculated by Expression 20 does not depend on frequency values for random inputs in the bands of interest. Therefore, the peak occurrence probability on the assumption that an input is random can be expressed as a function of a peak value. FIG. 15 shows an example of a graph where a peak occurrence probability is expressed as a function of a peak value. In FIG. 15, the horizontal axis represents the value of an index of periodicity, and the vertical axis represents a risk rate that a peak caused by random fluctuation is erroneously determined as an evidence for presence of a periodic signal. FIG. 15 shows an approximation curve by a quadratic function. For the window function, a Blackman window is used. As will be apparent from FIG. 15, it can be seen that when the risk rate of 1% is permitted, the threshold value for determination may be set as 1.19, when the risk rate is 0.1%, the threshold value for determination may be set as 1.41, and when the risk rate is 0.01%, the threshold value for determination may be set as 1.55. In the fundamental candidate extraction circuit 53, the threshold value for determination is set, and a fundamental frequency with high precision is extracted on the basis of the threshold value for determination.

In thus calculated periodic component, there is only a peak corresponding to the fundamental period, and no half pitch or multiple pitch occur. In the case of speech sound as an input signal, and when a sub-harmonic actually occurs in the vibration of vocal cords, peaks corresponding to multiple fundamental periods appear representing the structure of repetitions.

The fundamental candidate extraction circuit 53 selects a fundamental frequency to be extracted based on a fundamental period corresponding to any one of the peaks of the periodic component calculated by the periodicity integration circuit 52. This selection can be set by a user. For example, when an input signal is speech sound, only the maximum fundamental frequency is selected, or the maximum fundamental frequency and fundamental frequencies which are ½ or ⅓ of the maximum fundamental frequency are selected. When the maximum fundamental frequency and fundamental frequencies, which are ½ or ⅓ of the maximum fundamental frequency are selected, multiple fundamental frequencies in a hoarse voice can be extracted. As described above, in the fundamental period calculation unit 3, when a single fundamental frequency is calculated, or when there are multiple frequencies which meet the conditions for a fundamental frequency, multiple frequencies can be extracted. The fundamental candidate extraction circuit 53 outputs the selected fundamental frequency. The fundamental frequency outputted from the fundamental candidate extraction circuit 53 is provided to the TANDEM circuit 55, the STRAIGHT circuit 56, and the aperiodic component calculation circuit 54, and the fundamental period $T_0$ for use in these circuits is set in accordance with the provided fundamental frequency.

Figure 16:
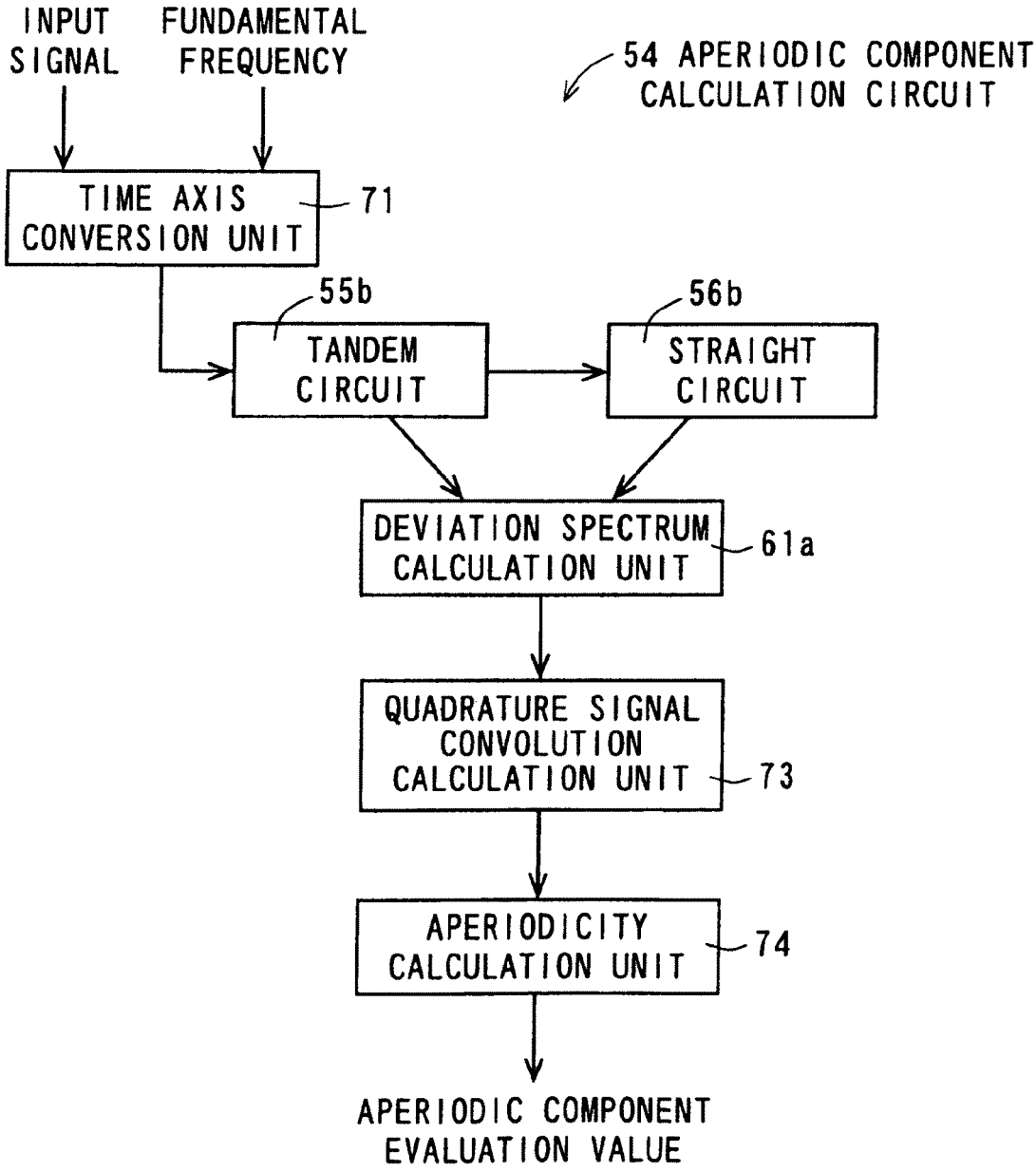
FIG. 16 is a schematic block diagram showing the configuration of an aperiodic component calculation circuit 54.

FIG. 16 is a schematic block diagram showing the configuration of the aperiodic component calculation circuit 54. The aperiodic component calculation circuit 54 analyzes and calculates an aperiodic component of the input signal. The aperiodic component is calculated as follows. It is assumed that the trajectory of the fundamental frequency and the series of the STRAIGHT spectrum are known, and an apparent fundamental frequency is made constant by contraction/dilation of the time axis in proportion to the reciprocal of a fundamental frequency as an instantaneous frequency. Then, a quadrature signal having an apparently constant fundamental frequency is convolved on a deviation spectrum calculated from the periodic signal newly obtained by contraction/dilation of the time axis by removing deviation of the spectrum in the analysis section at each frequency by using the series of the STRAIGHT spectrum, and the relative magnitude of the periodic component as the amplitude of a complex spectrum obtained from the result of convolution. The aperiodic component is calculated on the basis of the relative magnitude of the periodic component and a value calculated as a constant inherent in a window function used in calculation of the TANDEM spectrum.

The aperiodic component calculation circuit 54 includes a time axis conversion unit 71, a TANDEM circuit 55*b*, a STRAIGHT circuit 56*b*, a deviation spectrum calculation unit 61*a*, an orthogonal phase convolution unit 73, and an aperiodicity calculation unit 74.

The time axis conversion unit 71 contracts/dilates the time axis with a ratio in inverse proportion to the instantaneous frequency of the fundamental frequency for the input signal to convert the input signal into a signal having a frequency of an apparently constant fundamental period. The time axis conversion unit 71 divides the frequency of the current input signal by a set frequency as a target to calculate the ratio in inverse proportion to the instantaneous frequency of the fundamental frequency, and multiplies the frequency of the input signal by the ratio.

Specifically, if the instantaneous frequency of the fundamental frequency of a signal s(t) which temporally changes is $f_0(t)=\omega_0(t)/2\pi$, the waveform $s_0(t)$ of the fundamental component (with amplitude neglected) is expressed by Expression 24. Here, the phase $\phi(t)$ of the fundamental is expressed by Expression 25, and the initial value thereof is set to 0.

[Math. 23]

$$s_0(t)=\sin\phi(t) \tag{24}$$

[Math. 24]

$$\phi(t)=\int_0^t \omega_0(\tau)d\tau \tag{25}$$

From here, let a new variable $\lambda(t)$ be calculated by Expression 26. The variable $\lambda(t)$ represent a time axis when the phase changes at a constant speed $2\pi f_{TGT}$.

[Math. 25]

$$\lambda(t)=\frac{\phi(t)}{2\pi f_{TGT}} \tag{26}$$

If $s_0(t)$ is expressed as a function of $\lambda$ by using the time axis, it can be understood that the instantaneous frequency becomes a constant $f_{TGT}$. Therefore, if there is a signal whose fundamental frequency is known, the input signal can be converted into a signal having a constant fundamental frequency constant $f_{TGT}$, by representing the signal on the time axis that is calculated by Expression 26.

The TANDEM circuit 55*b* has the same configuration as the above-described TANDEM circuit 55, and the STRAIGHT circuit 56*b* has the same configuration as the above-described STRAIGHT circuit 56. The input signal whose time axis is converted by the time axis conversion unit 71 is provided to the TANDEM circuit 55*b*, and a TANDEM spectrum outputted from the TANDEM circuit 55*b* is provided to the STRAIGHT circuit 56*b* and the deviation spectrum calculation unit 61*a*. The STRAIGHT circuit 56*b* generates a STRAIGHT spectrum for the provided TANDEM spectrum and outputs the generated STRAIGHT spectrum to the deviation spectrum calculation unit 61*a*.

The deviation spectrum calculation unit 61*a* has the same configuration as the deviation spectrum calculation unit 61.

The deviation spectrum calculation unit 61*a* divides the TANDEM spectrum provided by the TANDEM circuit 55*b* by the STRAIGHT spectrum provided by the STRAIGHT circuit 56*b*, subtracts a numerical value "1" from the result, and provides the obtained deviation spectrum to the quadrature signal convolution unit 73.

If a fundamental is known, as described above, the input signal can be converted into a signal having a fundamental frequency of an arbitrary constant by converting the time axis. Let $f_C=\omega_C/2\pi=1/Tc$ represent this arbitrary value. In the aperiodic component calculation circuit 54, as a result, it should suffice that aperiodicity is evaluated only for the fundamental frequency component. Meanwhile, when there are multiple candidates of the fundamental frequency, or when there are sub-harmonics, the frequencies should be evaluated.

First, to examine the intensity of the periodic structure on the frequency axis by the fundamental frequency component, a quadrature signal shown in Expression 27 is created.

[Math. 26]

$$h_N(\omega;Tc)=w_{\omega C,N}(\omega)\exp(2\pi j\omega/\omega_C) \tag{27}$$

Here, $w_{\omega c,N}(\omega)$ is an amplitude envelope in the spatial frequency direction for use in the examination of the periodic structure and, for example, may be expressed as Expression 28 using a raised cosine type function.

[Math. 27]

$$w_{\omega_C N}(\omega)=c_0(1+\cos(\pi\omega/N\omega_C)) \tag{28}$$

The quadrature signal is used to calculate the following expression representing the intensity of a component in the deviation spectrum $Pc(\omega;Tc)$ which changes at speed of $\omega_C$:

$$\tilde{\sigma}_{P.obs}^2(\omega;Tc) \quad \text{[Math. 28]}$$

First, in the same manner as Expression 17, the $Pc(\omega;Tc)$ is expressed by Expression 29.

[Math. 29]

$$Pc(\omega;Tc)=\frac{P_T(\omega;Tc)}{P_{TST}(\omega;Tc)}-1 \tag{29}$$

Here, $Pc(\omega;Tc)$ represents a TANDEM spectrum, and $P_{TST}(\omega;Tc)$ represents a STRAIGHT spectrum. Tc is appended so as to specify the used fundamental period. For the calculation of TANDEM for use in the evaluation of aperiodicity, similarly to the estimation of $f_0$, it is necessary to set a time window for initial use such that good evaluation can be done with periodicity. For example, a Blackman window having a length four times larger than Tc is used.

The quadrature signal $h_N(\omega;Tc)$ as described above is convolved on the deviation spectrum $Pc(\omega;Tc)$, the intensity of periodicity on the frequency axis due to the periodicity of the original signal can be calculated. Since this signal is observable, the following notation is used.

$$\tilde{\sigma}_{P.obs}^2(\omega;Tc) \quad \text{[Math. 30]}$$

The signal which is observed includes both $\sigma^2_{P.obs}(\omega)$ by the original periodic component and a component, expressed by:

$$\epsilon_{wN}\tilde{\sigma}_N^2(\omega) \quad \text{[Math. 31]}$$

which is picked up by the quadrature signal $h_N(\omega;Tc)$ from the aperiodic component. Here, $$\tilde{\sigma}_N^2 \quad \text{[Math. 32]}$$

represents the variance of the aperiodic component, and $\epsilon_{wN}$ represents a ratio at which an aperiodic component is picked up by the quadrature signal. $\epsilon_{wN}$ is determined by an envelope $w_{\omega C,N}(\omega)$. The signal which is observed is expressed by Expression 30.

[Math. 33]

$$\begin{aligned}\tilde{\sigma}_{P.obs}^2(\omega;Tc)&=\left|\int_{-\infty}^{\infty}h_N(\lambda;Tc)Pc(\omega-\lambda;Tc)d\lambda\right|^2\\&=\sigma_{P.obs}^2(\omega)+\varepsilon_{wN}\tilde{\sigma}_N^2\end{aligned} \tag{30}$$

Each value is the amount which cannot be directly observed, so any approximation is used to introduce a calculation method for calculating the relevant value from the amount capable of being observed, as described below. The convolution by the quadrature signal is represented by a symbol "o". If the evaluation value (observation value) obtained as the absolute value of the result of convolution is represented by $Q_C$, $Q_C^2$ is provided by Expression 31. The value of $Q_C^2$ represents the same as Expression 30.

[Math. 34]

$$\begin{aligned}Q_C^2&=|h_N\cdot Pc(\omega;Tc)|^2\\&=\left|h_N\cdot\frac{P_T(\omega;Tc)}{P_{TST}(\omega;Tc)}-1\right|^2\\&=\left|h_N\cdot\frac{P_T(\omega;Tc)-P_{TST}(\omega;Tc)}{P_{TST}(\omega;Tc)}\right|^2\end{aligned} \tag{31}$$

It should be noted that the TANDEM spectrum is a spectrum in which a periodic deviation amount which is selectively removed by $h_N$ is added to the STRAIGHT spectrum, and the periodic deviation amount includes an amount due to periodicity of a signal and an amount due to random change of a signal. Here, $\Delta P_P$ denotes a deviation amount due to periodicity of a signal, $\Delta P_R$ denotes a deviation amount due to random change, $P_P$ denotes a STRAIGHT spectrum of a periodic component, and $P_R$ denotes a STRAIGHT spectrum of a random component.

Assume that $P_P(\omega;Tc)$ and $P_R(\omega;Tc)$ are regarded as constant within the width of the support of $h_N$. Then, Expression 32 is obtained.

[Math. 35]

$$Q_C^2=\frac{V[h_N\cdot\Delta P_P]}{P_P+P_R}+\frac{V[h_N\cdot\Delta P_R]}{P_P+P_R} \tag{32}$$

In the case of a periodic signal, if a window function is determined, the value of $V[h_N\circ\Delta P_P]$ is uniquely determined as a constant $C_P$ multiple of $P_P$. Further, if a window function and $h_N$ are determined, the value $V[h_N\circ P_R]$ of a random component is uniquely determined from an effective TB product as a constant $C_R$ multiple of $P_R$ (because of an expected value). As a result, Expression 33 is obtained.

[Math. 36]

$$Q_C^2=\frac{C_PP_P}{P_P+P_R}+\frac{C_RP_R}{P_P+P_R} \tag{33}$$

Let aPRD(ω) represent the average of periodic components in terms of root mean squared value and aRND(ω) represent the average of aperiodic components. Then, they are given by Expression 34.

[Math. 37]

$$aRND(\omega) = \sqrt{\frac{C_P - Q_C^2}{C_P - C_R}} \qquad (34)$$

$$aPRD(\omega) = \sqrt{\frac{Q_C^2 - C_R}{C_P - C_R}}$$

The quadrature signal convolution unit 73 calculates an absolute value by convolution of a quadrature signal having an apparently constant fundamental frequency and a deviation spectrum provided from the deviation spectrum calculation unit 61*a*.

The aperiodicity calculation unit 74 calculates the average amplitude aPRD(ω) of periodic components represented in terms of root mean squared value and the average amplitude aRND(ω) of aperiodic components from the operation result of the quadrature signal convolution unit 73, and outputs them as an aperiodic component evaluation value. The two values, that is, aPRD(ω) and aRND(ω), are used as information for diagnosis of speech sound, and are used for determination of power for every band of a pulse component and for determination of power for a random component at the time of speech synthesis.

A parameter conversion unit including the smoothed spectrum conversion unit 4, the sound source information conversion unit 5, and the phase adjustment unit 6 adjusts parameters taking into consideration the aperiodic component evaluation value provided from the aperiodic component calculation circuit 54. The aperiodic component evaluation value is used so as to improve quality in speech synthesis. The aperiodic component evaluation value is used as the weight of a smoothed spectrum so as to determine the shape of a filter which is driven by noise or to determine the shape of a filter which is driven by a periodic signal as a remainder.

Figure 17A:
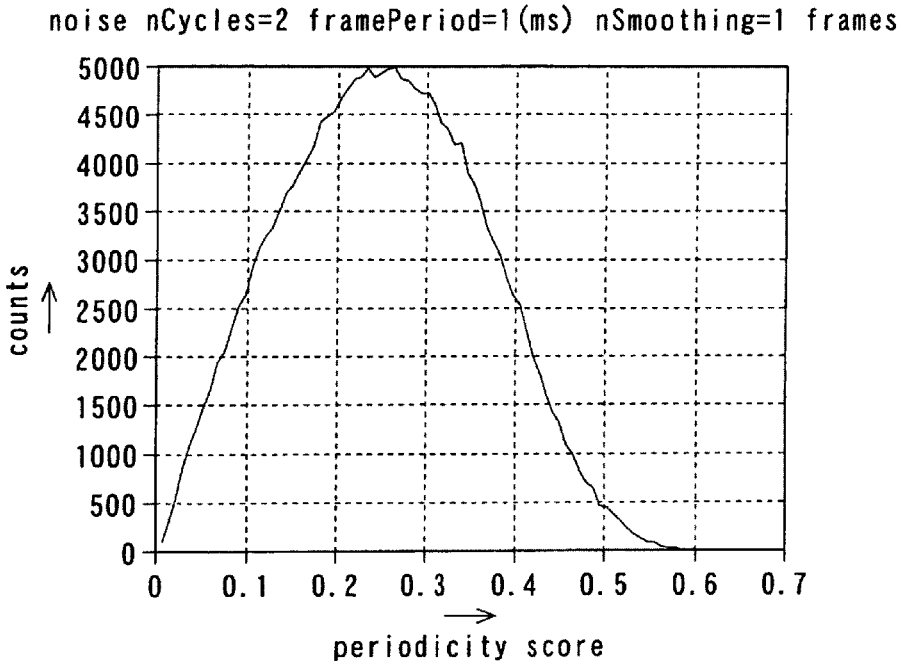
FIG. 17A shows the distribution of an observation value $Q_C$ when N=2.
Figure 17B:
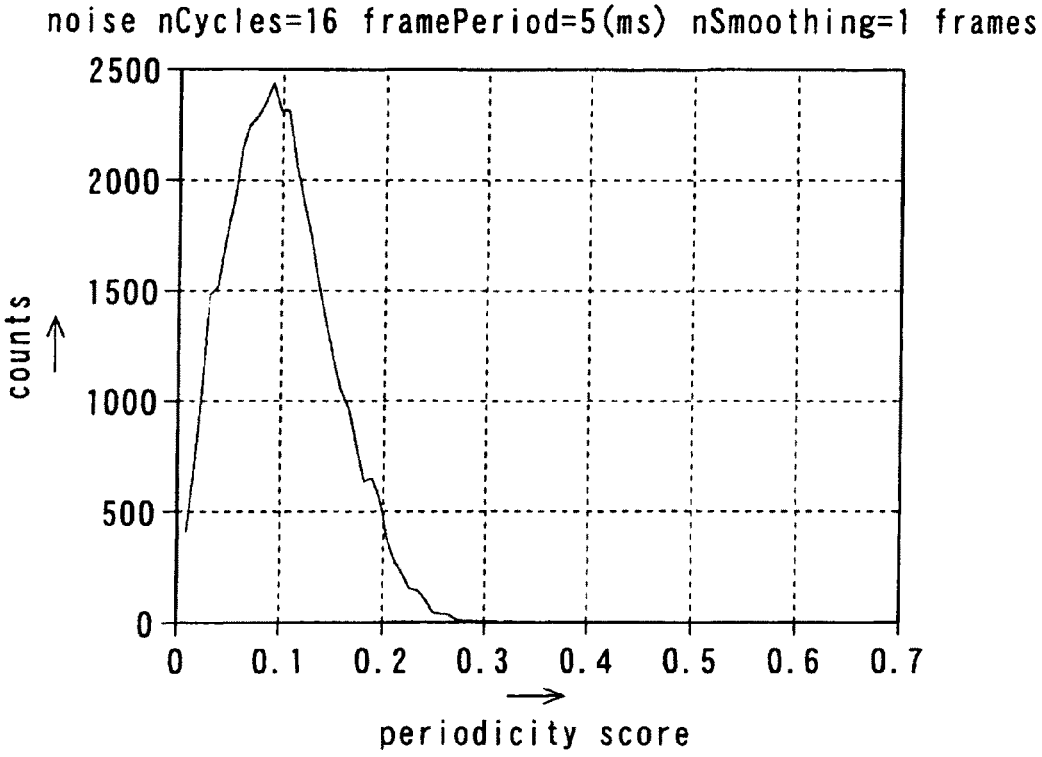
FIG. 17B shows the distribution of the observation value $Q_C$ when N=16.

To calculate aPRD(ω) and aRND(ω), in addition to the value $Q^2_C$ obtained by measurement, $C_P$ determined by a window for use in TANDEM and the statistical nature of $C_R$ which changes depending on analysis conditions are required. For example, in analysis using a Blackman window which is 2.4 times larger than the fundamental period, while there is a slight difference according to simulation settings, $C_P$=0.56 was obtained. A coefficient $C_R$ for a random component depends on N which represents the extension of the quadrature signal $h_N(\omega;Tc)$ in the frequency direction. FIG. 17A shows the distribution of an observation value $Q_C$ when N=2. FIG. 17B shows the distribution of the observation value $Q_C$ when N=16. In FIGS. 17A and 17B, the horizontal axis represents periodicity, and the vertical axis represents an observation value. As will be apparent from the drawings, when N=2, the distribution is largely extended. This means that the variance of an estimation value in actual signal analysis increases.

To avoid this problem, it is necessary to increase a TB product by averaging the results in a plurality of analysis frames. In this embodiment, $Q_C$ is calculated by a simulation for all combinations of the analysis frame period, the extension N in the frequency direction, and the number of frames for integration so as to cover a range which is likely to be actually used, and the average value and variance are stored in the form of a three-dimensional table. A necessary value of $C_R$ is obtained from the table by linear interpolation. In actual calculation, the value of $C_R$ is obtained by adding a constant multiple of the standard derivation of $Q_C$ to the average value of $Q_C$ which meets the relevant conditions. The specific value of the constant is determined by a subjective evaluation experiment and a simulation or the like using objective evaluation which optimizes the conditions for consistency of the evaluation value.

$Q_C$ of Expression 34 includes a random component, so it is probabilistically fluctuated. For this reason, when $Q_C$ is used as it is, an unreasonable value such as an aperiodic component which has negative power and exceeds 100% may be obtained. Here, a value x in a root sign of Expression 36 is converted by Expression 35.

[Math. 38]

$$g(x) = \frac{1}{\alpha}\log\frac{1 + \exp(-\alpha x)}{1 + \exp(-\alpha(x-1))} + 1 \qquad (35)$$

Here, α is a value for determining softness and determined by a hearing test or the like.

As described above, in the periodic signal conversion device 50, even when the fundamental frequency of a speech signal as an input signal is extended or reduced, a fundamental frequency according to the fundamental frequency at that time can be calculated. Even when a fundamental frequency changes, the width of a TAMDEM window is reduced to follow a fundamental period, so even when the fundamental frequency changes, the fundamental frequency can be accurately calculated. Therefore, sound resulting from synthesis or transformation is generated by using such a fundamental frequency, such that, if a time window of an appropriate size is selected in accordance with the fundamental frequency, upon speech synthesis, signals can be synthesized such that the same fundamental frequency as the original signal is extracted. As a result, the quality of sound resulting from synthesis and transformation can be improved. In addition, when a signal synthesized by using an extracted fundamental frequency is re-analyzed, design can be done such that the same fundamental frequency as that for use in the synthesis is obtained. Furthermore, a signal having a plurality of fundamental frequencies can be appropriately analyzed, so analysis and synthesis of a hoarse voice which cannot be appropriately performed until now is enabled.

The influence of temporal changes of a fundamental frequency and temporal changes of a spectrum can be prevented from being extracted as an aperiodic component, so an accurate fundamental frequency for use in synthesis can be extracted. The quality of speech sound resulting from synthesis and processing can be improved. In addition, in the invention, an aperiodic component estimation method does not include nonlinear processing on an ambiguous basis, so the invention can be applied to medical diagnosis using a voice. Furthermore, an aperiodic component can be calculated while temporal changes in the fundamental frequency and spectrum are excluded, an accurate aperiodic value for use in synthesis can be extracted.

In the periodic signal conversion device 50, with regard to a fundamental component and an aperiodic component, evaluation indices which can be interpreted as probabilities are obtained. In addition, in realizing the periodic signal conversion device 50, during an actual operation, fast Fourier transform can be used for various purposes, such that fast analysis and synthesis can be realized.

The peak position obtained by the periodicity integration circuit 52 is biased toward shorter lag, because the peak obtained by the above-described periodicity integration circuit 52 is multiplied by the window, which is a function of the time lag in the initial TANDEM time window. In the periodicity integration circuit 52, the initial estimation value may be revised to improve accuracy by using an instantaneous frequency. The Flanagan's formula is used in calculation of the instantaneous frequency. The value $X(\omega_0)$ of short term Fourier transform at an angular frequency $\omega_0$ can be calculated by using a quadrature signal. Specifically, the same quadrature signal as in Expression (27) is created. Let $X(\omega_0)$ be represented in terms of its real part and imaginary part as follows.

$$X(\omega_0)=a+jb \tag{36}$$

Under this notation, the Flanagan's formula is expressed by Expression 37.

[Math. 39]

$$\lambda(\omega) = \omega + \frac{a\frac{\partial b}{\partial t} - b\frac{\partial a}{\partial t}}{a^2 + b^2} \tag{37}$$

Here, the nature of Expression 38 of Fourier transform is used.

[Math. 40]

$$\frac{\partial F[x(t)]}{\partial t} = F[tx(t)] \tag{38}$$

Specifically, the quadrature signal is created by using an initial estimation value $\omega_0$ of the fundamental frequency, and an instantaneous frequency $\lambda_0=\lambda(\omega_0)$ at $\omega_0$ is calculated by using the quadrature signal. Thus calculated instantaneous frequency can be expected to be closer to the true value of the fundamental frequency than the initial estimation value. However, since the initial estimation value includes a bias, a bias generally remains in the instantaneous frequency. A correct frequency is calculated as a fixed point of mapping from a frequency to an instantaneous frequency. Thus, when an instantaneous frequency $\lambda_1$ corresponding to an initial value $\omega_1=\beta\omega_0$ different from the initial estimation value is calculated in the same manner, Relational Expression 39 is established.

[Math. 41]

$$\begin{bmatrix} \lambda_0 \\ \lambda_1 \end{bmatrix} = \begin{bmatrix} \omega_0 & 1 \\ \omega_1 & 1 \end{bmatrix} \begin{bmatrix} u_0 \\ u_1 \end{bmatrix} \tag{39}$$

From Expression 39, by multiplying an inverse matrix of a coefficient matrix by a vector composed of two calculated instantaneous frequencies, coefficients $u_0$ and $u_1$ of a linear function approximation of mapping from a frequency to an instantaneous frequency are calculated. Here, under the condition $\lambda(\omega)=\omega$ of the fixed point (another condition is not mentioned here), an improved estimation value $\omega_{r1}$ of the fundamental frequency can be calculated by Expression 40 on the basis of $u_0$ and $u_1$.

[Math. 42]

$$\omega_{r1} = \frac{u_1}{1 - u_0} \tag{40}$$

With thus calculated improved estimation value $\omega_{r1}$ of the fundamental frequency as an initial value, an instantaneous frequency is calculated at high and low frequencies with respect to the initial value by Expression 29, and a further improved estimation value $\omega_{r2}$ can be calculated by Expressions 31 and 32. Although the fundamental frequency includes an error, if the estimation value is improved as described above, the error can be equal to or smaller than about 1% by once correction. The error can be equal to or smaller than 0.2% by twice correction.

If a relationship between an evaluation value and an erroneous determination risk rate is determined, a fundamental component periodicity evaluation value and an aperiodic component evaluation value can be acquired, and it can be determined from the relationship how much the fundamental frequency is reliable. For example, if the fundamental frequency of the input signal is "XX" Hz, and information that the erroneous determination risk rate of the fundamental frequency is "XX" % is outputted, the reliability of the analyzed fundamental frequency can be easily determined. The relationship between the evaluation value and the erroneous determination risk rate may be actually obtained by a simulation insofar as the fundamental frequency can be extracted.

Figure 18:
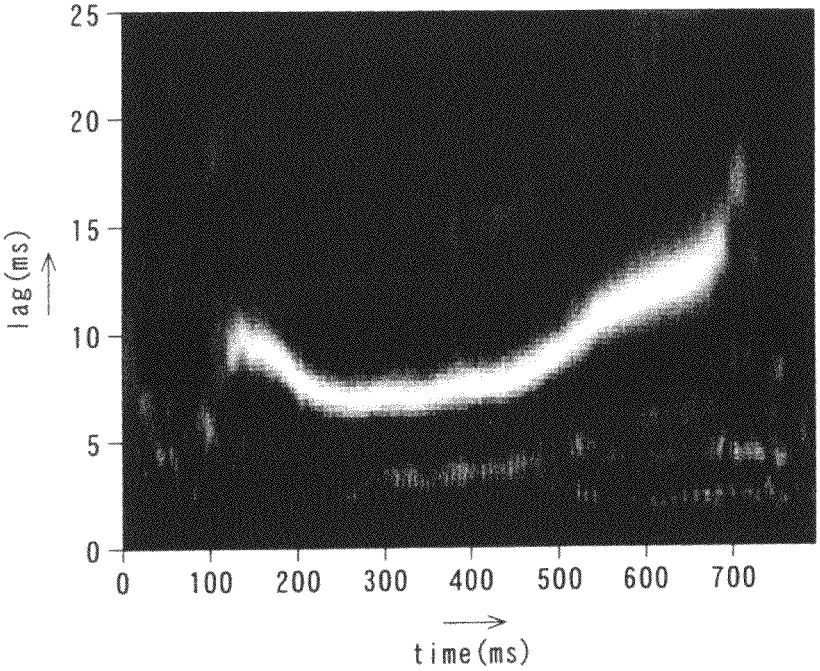
FIG. 18 is a diagram showing an example of an analysis result of a speech signal by the fundamental period calculation unit 3.
Figure 19:
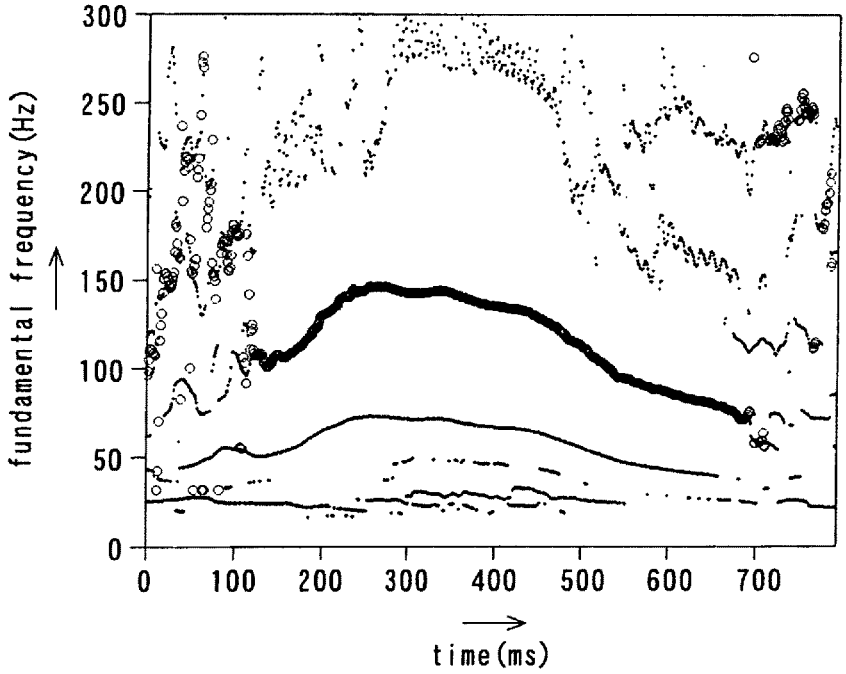
FIG. 19 is a diagram showing an example of an analysis result of a speech signal by the fundamental period calculation unit 3.
Figure 20:
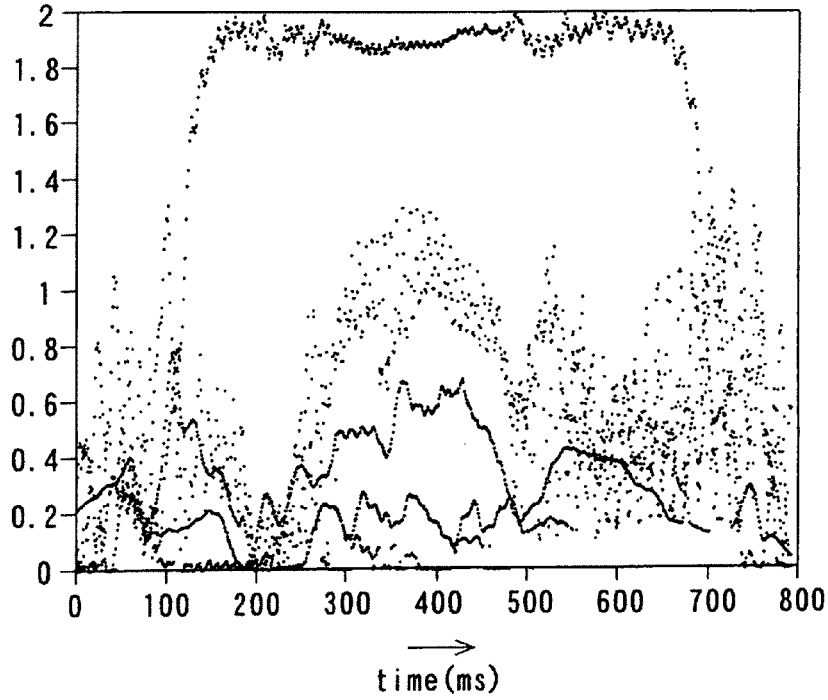
FIG. 20 is a diagram showing an example of an analysis result of a speech signal by the fundamental period calculation unit 3.

FIGS. 18, 19, and 20 are diagrams showing an example of an analysis result of a speech signal by the fundamental period calculation unit 3. In this case, for a Japanese continuous vowel "AIUEO" uttered by a male as a sample, a periodic component (Expression 22) is calculated at every point of time. The sampling frequency of the sample is 22050 Hz. Here, to examine the fluctuation of the periodic component (Expression 22) in detail, analysis was made every 1 ms. It is assumed that the number of assumed fundamental periods is nine in total including two for every octave with the maximum fundamental period of 32 ms. FIG. 18 shows an analysis result when the length N of the quadrature signal is 10. FIG. 18 shows an analysis result by a grayscale image. In FIG. 18, the horizontal axis represents time and the vertical axis represents lag. In FIG. 18, a portion having intensive periodicity has light concentration (white). The lag corresponding to the fundamental period also becomes apparent from FIG. 18. FIG. 19 shows positions where the periodicity has local maximum values at respective points of time. In FIG. 19, the horizontal axis represents time, and the vertical axis represents frequency (reciprocal of lag), unlike FIG. 18. In FIG. 19, symbol "o" is used to indicate the trajectory of the maximum value of the frequency. Referring to FIG. 19, it can be seen that a fundamental frequency is correctly extracted, excluding part of the start and end portions of the vowel. FIG. 20 shows all local maximum values at respective points of time. Referring to FIG. 20, it can be seen that a fundamental component is prominent, and a second-order component is clearly perceived.

Figure 21:
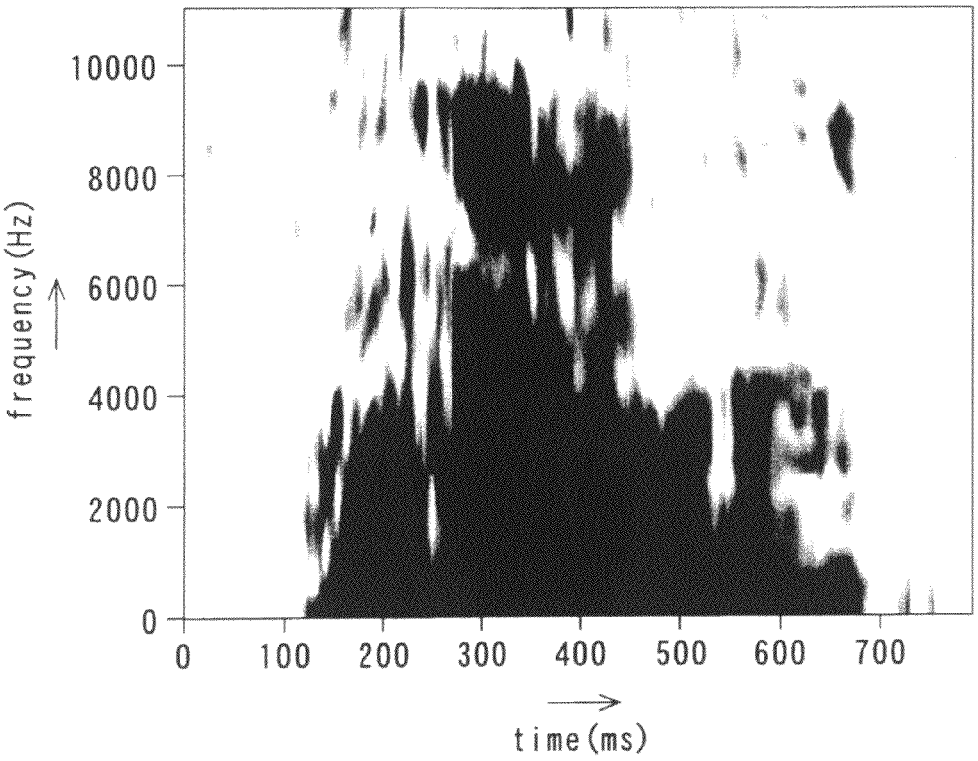
FIG. 21 is a diagram showing an analysis result of a speech signal by an aperiodic component calculation circuit 54.

FIG. 21 is a diagram showing an analysis result of a speech signal by the aperiodic component calculation circuit 54. A sample of the speech signal is the same as described above. FIG. 21 shows an analysis result by a grayscale image. In FIG. 21, the horizontal axis represents time, and the vertical axis represents frequency. Further, a portion having an intensive aperiodic component has light concentration (white).

Although in the above description, the periodic signal conversion devices 1 and 50 have been described, the invention can be applied, in addition to speech synthesis and speech conversion, (a) extraction of fundamental frequency information in a speech analysis and synthesis system or a speech coding device, (b) extraction of aperiodic information in a speech analysis and synthesis system or a speech coding device, and detection of a speech signal in a speech recognition system, (c) detection of a speech signal and extraction of fundamental frequency information in provision of additional information (annotation) to sound archive, (d) extraction of fundamental frequency information in a music search system by hum or the like, (e) extraction of sound source information (fundamental frequency and aperiodicity) in diagnosis of voice impairment by voice, and the like.

For example, a recorder includes the above-described fundamental period calculation unit 3, a fundamental frequency is extracted from a speech signal acquired by a microphone, if it is determined whether or not the fundamental frequency is identical to the frequency of a human voice, it is determined whether or not a human speaks around the microphone, and when a human speaks, recording may be automatically performed. According to the invention, the fundamental frequency is extracted from the speech signal acquired by the microphone, and if it is determined whether or not the fundamental frequency is identical to the frequency of the human voice, what the human speaks can be extracted from the speech signal. According to the invention, it is possible to detect whether an input signal is completely random noise or a periodic signal. In addition, according to the invention, a fundamental frequency included in a speech signal can be accurately calculated, so presence/absence of abnormality of voice cords can be determined.

In another embodiment of the invention, the portions capable of being combined in the above-described embodiment may be combined. For example, the STRAIGHT circuit 56 may include the second portion 12 and the third portion 13 shown in FIG. 3 to output the optimum time frequency smoothed power spectrum.

The invention may be embodied in other forms without departing from the spirit or essential characteristics of the invention. The foregoing embodiments are therefore to be considered in all respects as illustrative and not restrictive, the scope of the invention being indicated by the appended claims rather than by the foregoing description and all changes which come within the meaning and the range of equivalents of the claims are therefore intended to be embraced therein.

INDUSTRIAL APPLICABILITY

According to the invention, for a signal having periodicity, a power spectrum which does not depend on an analysis position can be obtained, and a power spectrum with high precision can be calculated. With simple processing for arranging time windows such that a center of each of the time windows is at a division position which divides a fundamental frequency in a temporal direction into fractions 1/n (where n is an integer equal to or larger than 2) so as to extract a plurality of portions of different ranges for a signal having periodicity, calculating a power spectrum for a plurality of portions extracted by the respective time windows, and adding the calculated power spectrum with the same ratio, a power spectrum which does not depend on an analysis position can be obtained, and to obtain a power spectrum which does not depend on an analysis position, complex calculation and parameter adjustment are not required, or only an extremely limited small number of parameters may be set. Therefore, design can be easily performed for any purpose, and only functions which can be simply calculated can be used, so a spectrogram which does not depend on an analysis time can be obtained in short time and simply.

The time windows are arranged such that the center of each of the time windows is arranged at the division position which divides the fundamental period in the temporal direction into fractions 1/n (where n is an integer equal to or larger than 2), so time-dependent changes in the signal can become zero (0).

According to the invention, a power spectrum which does not depend on an analysis position can be used, a spectrum which does not depend on an analysis position and has removed periodicity in the frequency direction can be calculated. Thus, a spectrum which has removed periodicity in the temporal direction and the frequency direction is used in speech synthesis, speech conversion, speech recognition, and the like, such that the quality of sound resulting from synthesis or conversion and the recognition rate of speech recognition can be improved.

According to the invention, a power spectrum is calculated for every range in the frequency direction, and the difference in the power spectrum for the predetermined range between two points at a predetermined interval in the frequency direction is calculated and subjected to linear interpolation. Therefore, a further smoothed spectrogram in the frequency direction can be obtained, and the signal intensity in the frequency direction can be smoothed, thereby reducing noise.

According to the invention, a smoothed power spectrum obtained by the linear interpolation is subjected to logarithmic transformation, predetermined correction, and exponential transformation, such that a power spectrum for an extremely smoothed portion by the above-described respective processing can be restored to the original state. In particular, in processing a speech signal, a spectrum true for speech sound can be obtained.

According to the invention, a periodic signal is converted into a different signal by using a smoothed spectrogram. For this reason, the influence of periodicity in the frequency direction and the temporal direction can be reduced. Therefore, the temporal resolution and the frequency resolution can be determined in a well balanced manner.

According to the invention, the value of a fundamental period can be calculated with high precision. The fundamental frequency is represented by the reciprocal of the value of the fundamental period. If a time window of an appropriate size is selected in accordance with the fundamental frequency, upon speech synthesis, signals can be synthesized such that the same fundamental frequency as the original signal is extracted. In addition, a signal having a plurality of fundamental frequencies can be appropriately analyzed, so analysis and synthesis of a hoarse voice which cannot be appropriately performed until now is enabled.

According to the invention, aperiodicity can be accurately estimated. If accurately estimated aperiodicity is used, in speech synthesis and speech conversion, the quality of speech sound resulting from synthesis and processing can be improved. In addition, an aperiodicity estimation method includes no nonlinear processing on an ambiguous basis, such that the invention can be applied to diagnosis using voice or the like.

The invention claimed is:

1. A periodic signal processing method comprising:

extracting, from a signal having periodicity, a fundamental period of the signal in a temporal direction;

arranging n sets of time windows such that centers of each of the n sets of time windows are separated by a fraction 1/n of the fundamental period, where n is an integer equal to or larger than 2, so as to extract n sets of portions of different ranges from the signal having periodicity;

calculating n set of power spectrums for the n set of portions extracted by the respective time windows;

adding the whole n sets of power spectrums with a same ratio to obtain a first power spectrum, calculating a second power spectrum by convolving a rectangular smoothing function having a width corresponding to a fundamental frequency in a frequency direction on the obtained first power spectrum, wherein the extracting fundamental period, the arranging time windows, the calculating power spectrums, and the adding at least two of the calculated power spectrums are performed by a processor programmed to perform the extracting fundamental period, the arranging time windows, the calculating power spectrums, and the adding at least two of the calculated power spectrums.

2. A periodic signal analysis method, comprising:

performing the periodic signal processing method of claim 1;

dividing the first power spectrum by the second power spectrum;

obtaining a deviation spectrum with only a component due to periodicity obtained by subtracting 1 from a result obtained by the division of the first power spectrum; and obtaining a value of the fundamental period by calculating a weighted Fourier transform.

3. A periodic signal analysis method, comprising:

performing the periodic signal processing method of claim 1; and contracting or dilating a time axis with a ratio in inverse proportion to an instantaneous frequency of a frequency of a fundamental period; and, for a first signal having periodicity converted so as to apparently become a signal having a frequency of a predetermined fundamental period, calculating a ratio of a periodic component in the first signal as an absolute value of a signal, which is obtained by convolving a quadrature signal designed using a frequency of a fundamental period set in advance on a deviation spectrum with only a component due to periodicity obtained by subtracting 1 from a result obtained by dividing the first power spectrum by the second power spectrum, so as to calculate a ratio of an aperiodic component in the signal.

4. A periodic signal conversion method, comprising:

performing the periodic signal processing method of claim 1; and converting the signal having periodicity into a different signal by using at least one of the calculated power spectrums and the first power spectrum.

5. A periodic signal conversion method, comprising:

performing the periodic signal processing method of claim 1; and converting the signal having periodicity into a different signal by using the second power spectrum.

6. A periodic signal processing method, comprising:

extracting, from a signal having periodicity, a fundamental period of the signal in a temporal direction;

arranging n sets of time windows such that centers of each of the n sets of time windows are separated by a fraction 1/n of the fundamental time period, where n is an integer equal to or larger than 2, so as to extract n sets of portions of different ranges from the signal having periodicity;

calculating n sets of power spectrums for the n sets of portions extracted by the respective time windows;

adding the whole n sets of power spectrums with a same ratio to obtain a first power spectrum;

calculating a cumulative sum of the first power spectrum for every predetermined range in the frequency direction; and calculating a difference in the cumulative sum of the first power spectra in the predetermined range between two points at a predetermined interval in the frequency direction and performing linear interpolation to obtain a smoothed power spectrum, wherein the extracting fundamental period, the arranging time windows, the calculating power spectrums, and the adding groups of at least two of the calculated power spectrums are performed by a processor programmed to perform the extracting fundamental period, the arranging time windows, the calculating power spectrums, and the adding groups of at least two of the calculated power spectrums.

7. The periodic signal processing method of claim 6, further comprising:

obtaining a second power spectrum by subjecting the smoothed power spectrum obtained by the linear interpolation to logarithmic transformation, predetermined correction, and exponential transformation.

8. A periodic signal analysis method, comprising:

performing the periodic signal processing method of claim 7;

dividing the first power spectrum by the second power spectrum;

obtaining a deviation spectrum with only a component due to periodicity obtained by subtracting 1 from a result obtained by the division of the first power spectrum; and obtaining a value of the fundamental period by calculating a weighted Fourier transform.

9. A periodic signal conversion method, comprising performing the periodic signal processing method of claim 7; and converting the signal having periodicity into a different signal by using the second power spectrum.

10. A periodic signal analysis method, comprising:

performing the periodic signal processing method of claim 6; and dividing the first power spectrum by the smoothed power spectrum;

obtaining a deviation spectrum with only a component due to periodicity obtained by subtracting 1 from a result obtained by the division of the first power spectrum; and obtaining a value of the fundamental period by calculating a weighted Fourier transform.

11. A periodic signal conversion method, comprising:

performing the periodic signal processing method of claim 6; and converting the signal having periodicity into a different signal by using the smoothed power spectrum.

12. A periodic signal processing device, comprising:

a fundamental period calculation unit configured to extract, from a signal having periodicity, a fundamental period of the signal in a temporal direction;

an extraction unit configured to arrange n sets of time windows such that centers of each of the n sets of time windows are separated by a fraction 1/n of the fundamental period, where n is an integer equal to or larger than 2, so as to extract n sets of portions of different ranges from the signal having periodicity;

a calculation unit configured to calculate n sets of power spectrums for the n sets of portions extracted by the respective time windows;

an addition unit configured to obtain a first power spectrum by adding the whole n sets of power spectrums with a same ratio; and a convolution unit configured to calculate a second power spectrum by convolving a rectangular smoothing function having a width corresponding to a fundamental frequency in a frequency direction on the first power spectrum.

* * * * *